US009359686B1

(12) United States Patent
Curran et al.

(10) Patent No.: US 9,359,686 B1
(45) Date of Patent: Jun. 7, 2016

(54) PROCESSES TO REDUCE INTERFACIAL ENRICHMENT OF ALLOYING ELEMENTS UNDER ANODIC OXIDE FILMS AND IMPROVE ANODIZED APPEARANCE OF HEAT TREATABLE ALLOYS

(71) Applicant: Apple Inc., Cupertino, CA (US)

(72) Inventors: James A. Curran, Morgan Hill, CA (US); William A. Counts, Sunnyvale, CA (US); Eric W. Hamann, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/593,845

(22) Filed: Jan. 9, 2015

Related U.S. Application Data

(63) Continuation of application No. PCT/US2015/010736, filed on Jan. 9, 2015.

(51) Int. Cl.
*C25D 11/04* (2006.01)
*C25D 11/18* (2006.01)

(52) U.S. Cl.
CPC ..... *C25D 11/04* (2013.01); *C25D 11/18* (2013.01)

(58) Field of Classification Search
CPC ..... C25D 11/18; C25D 11/246
USPC ..... 205/224, 229
See application file for complete search history.

(56) References Cited

U.S. PATENT DOCUMENTS

| | | | |
|---|---|---|---|
| 3,388,050 | A | 6/1968 | Wainer et al. |
| 3,411,994 | A | 11/1968 | Wainer et al. |
| 4,039,355 | A | 8/1977 | Takahashi et al. |
| 4,066,516 | A | 1/1978 | Sato |
| 5,078,845 | A | 1/1992 | Kunugihara et al. |
| 5,277,788 | A | 1/1994 | Nitowski et al. |
| 5,336,341 | A | 8/1994 | Maejima et al. |

(Continued)

FOREIGN PATENT DOCUMENTS

| | | |
|---|---|---|
| JP | 2000313996 | 11/2000 |
| KR | 1020120021616 | 3/2012 |

OTHER PUBLICATIONS

Garcia-Vergara, S. et al; "Morphology of enriched alloy layers in an anodized Al—Cu alloy" Applied Surface Science, 205 (2003), p. 121-127.*

(Continued)

*Primary Examiner* — Nicholas A Smith
*Assistant Examiner* — Brian W Cohen
(74) *Attorney, Agent, or Firm* — Downey Brand LLP

(57) ABSTRACT

Anodic oxide coatings and methods for forming anodic oxide coatings on metal alloy substrates are disclosed. Methods involve post-anodizing processes that improve the appearance of the anodic oxide coating or increase the strength of the underlying metal alloy substrates. In some embodiments, a diffusion promoting process is used to promote diffusion of one or more types of alloying elements enriched at an interface between the anodic oxide coating and the metal alloy substrate away from the interface. The diffusion promoting process can increase an adhesion strength of the anodic oxide film to the metal alloy substrate and reduce an amount of discoloration due to the enriched alloying elements. In some embodiments, a post-anodizing age hardening process is used to increase the strength of the metal alloy substrate and to improve cosmetics of the anodic oxide coatings.

20 Claims, 16 Drawing Sheets

(56) References Cited

U.S. PATENT DOCUMENTS

| | | | | |
|---|---|---|---|---|
| 7,732,056 | B2 | 6/2010 | Bhatnagar et al. | |
| 8,691,403 | B2 | 4/2014 | Amakusa et al. | |
| 2006/0019035 | A1 | 1/2006 | Munz et al. | |
| 2008/0274375 | A1 | 11/2008 | Ng et al. | |
| 2008/0283408 | A1 | 11/2008 | Nishizawa | |
| 2010/0264036 | A1 | 10/2010 | Hatanaka et al. | |
| 2010/0326839 | A1 | 12/2010 | Morikawa et al. | |
| 2011/0297319 | A1* | 12/2011 | Chen | C25D 5/48 156/345.35 |
| 2012/0298513 | A1 | 11/2012 | Shimao et al. | |
| 2013/0153427 | A1 | 6/2013 | Tatebe | |
| 2013/0156635 | A1 | 6/2013 | Lee et al. | |
| 2013/0319872 | A1 | 12/2013 | Woodhull et al. | |
| 2014/0083861 | A1 | 3/2014 | Askin et al. | |

OTHER PUBLICATIONS

International Search Report and Written Opinion mailed Oct. 29, 2015 for PCT Application No. PCT/US2015/010736.

PCT Application No. PCT/US2014/053595—International Search Report & Written Opinion dated Jun. 24, 2015.

Habazaki et al., "Nanoscale Enrichments of Substrate Elements in the Growth of Thin Oxide Films", Corrosion Science, vol. 39, No. 4, pp. 731-737, 1997.

Vesborg et al., "Addressing the terawatt challenge: scalability in the supply of chemical elements for renewable energy," RSC Advances, 2, pp. 7933-7947, 2012.

U.S. Appl. No. 14/474,021—Non Final Office Action dated Aug. 27, 2015.

* cited by examiner

PROCESSES TO REDUCE INTERFACIAL ENRICHMENT OF ALLOYING ELEMENTS UNDER ANODIC OXIDE FILMS AND IMPROVE ANODIZED APPEARANCE OF HEAT TREATABLE ALLOYS

CROSS-REFERENCE TO RELATED APPLICATION

This is a continuation of International Application PCT/US15/10736, with an international filing date of Jan. 9, 2015, entitled "Processes To Reduce Interfacial Enrichment Of Alloying Elements Under Anodic Oxide Films and Improve Anodized Appearance of Heat Treatable Alloys", which is incorporated herein by reference in its entirety.

FIELD

This disclosure relates generally to anodizing systems and methods. In particular, systems and methods for improving the cosmetics and enhancing physical characteristics of anodic oxide films formed on metal alloy substrates are described.

BACKGROUND

Anodizing is a method of providing an anodic oxide layer or coating on a metal substrate, often used in industry to provide a protective and sometimes cosmetically appealing coating to metal parts. During an anodizing process, a portion of the metal substrate is converted to a metal oxide, thereby forming the anodic oxide layer or anodic oxide coating. The nature of the anodic oxide coatings can depend on a number of factors, including chemical makeup of the metal substrates and the process parameters used in the anodizing processes. In some applications, an anodic oxide coating is colored by infusing one or more dyes within pores of the anodic oxide coating, giving the metal part an attractive colored finish.

Unfortunately, in some cases where certain metal alloy substrates are used, the anodic oxide coating can peel, chip or otherwise delaminate from their metal substrates when exposed to scratching or scraping forces during normal use of the part, or even during certain manufacturing operations such as drilling or machining which might be performed after anodizing. This delamination can cause the underlying metal substrate to be exposed at chipped or peeled regions of the anodic oxide coating, leaving visible chip marks and rendering the metal substrate more susceptible to corrosion. This delamination can be at least partially attributed to alloying elements within the metal substrate that become enriched at an interface between the metal substrate and the anodic oxide coating.

In addition to making the anodic oxide coating more susceptible to delamination, the interfacial enrichment of alloying elements can contribute to the discoloration of the anodic oxide coating, which can detract from the aesthetic appeal of the part. In addition, anodizing metal alloy substrates that are hard tempered can result in the formation of very small groove defects that are detrimental to the function and cosmetics of the anodic oxide coating.

SUMMARY

This paper describes various embodiments that relate to anodizing processes and anodic oxide films using the same. The methods described are used to form an anodic oxide film on a metal alloy substrate such that the anodic oxide film is resistant to delamination and free from cosmetic defects related to alloying elements from the metal alloy substrate.

According to one embodiment, a method of treating a part including a metal alloy substrate is described. The method involves forming an anodic oxide film on the metal alloy substrate by anodizing the metal alloy substrate. Certain alloying elements from the metal alloy substrate are enriched at an interface between the metal alloy substrate and the anodic oxide film. The alloying elements enriched at the interface are associated with a reduced adhesion strength between the anodic oxide film and the metal alloy substrate. The method also involves diffusing at least some of the alloying elements enriched at the interface away from the interface toward one or both of the metal alloy substrate and the anodic oxide film such that the adhesion strength between the anodic oxide film and the metal alloy substrate is substantially increased.

According to another embodiment, a method of treating a part comprising a metal alloy substrate is described. The method involves converting a portion of the metal alloy substrate to an anodic oxide film. Certain alloying elements from the metal alloy substrate become enriched within an enrichment layer at an interface between the metal alloy substrate and the anodic oxide film. The alloying elements enriched within enrichment layer are associated with an amount of discoloration of the part. The method also involves removing at least a portion of the alloying element from the enrichment layer such that the amount of discoloration is reduced to a predetermined amount of discoloration.

According to a further embodiment, a method of treating a part that includes a metal alloy substrate is described. The method involves converting a portion of the metal alloy substrate to an anodic oxide film having anodic pores. Alloying elements from the metal alloy substrate are enriched at an interface between the metal alloy substrate and the anodic oxide film. The method also involves heating at least a portion of the part such that at least some of the alloying elements enriched at the interface are diffused away from the interface. The method further involves, after heating at least a portion of the part, exposing the part to a sealing process such that at least some of the anodic pores are sealed.

According to an additional embodiment, a method of treating a metal alloy substrate is described. The metal alloy substrate includes alloying elements within a metal matrix. The method includes anodizing the metal alloy substrate while in an age-hardenable state. A peak strength of the metal alloy substrate is accessible via a subsequent age hardening process. The method also includes, after anodizing, age hardening the metal alloy substrate by causing the alloying elements to form precipitate particles within the metal alloy substrate increasing the strength of the metal alloy substrate.

According to a further embodiment, a method of treating a metal alloy substrate is described. The metal alloy substrate includes alloying elements within a metal matrix. The method includes anodizing the metal alloy substrate while in an over-aged state. The alloying elements are aggregated in the form of precipitate particles that are substantially uniformly distributed within the metal matrix while in the over-aged state.

According to another embodiment, a method of treating an aluminum alloy substrate is described. The aluminum alloy substrate includes alloying elements within an aluminum matrix. The method includes placing the aluminum alloy substrate in an age-hardenable state by causing the alloying elements to become substantially uniformly distributed within the aluminum matrix. The method also includes converting a portion of the aluminum alloy substrate while in the age-hardenable state into an aluminum oxide film. The method further includes, after the converting, age-hardening the aluminum alloy substrate by causing the alloying elements to form precipitate particles within the aluminum alloy substrate such that the precipitate particles increase a strength of the aluminum alloy substrate.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
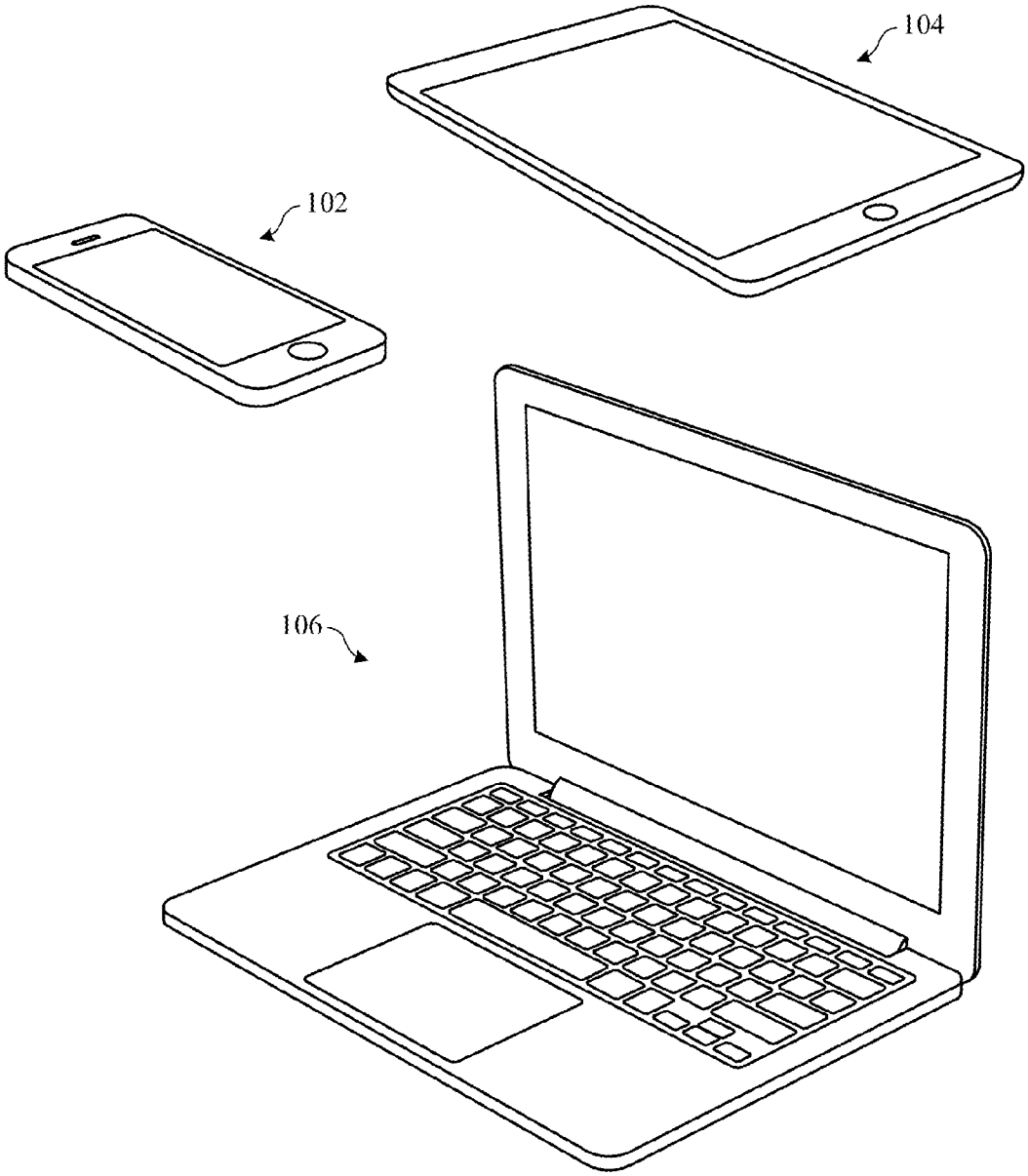
FIG. 1 shows perspective views of devices having metallic surfaces that can be protected using anodic oxide coatings, in accordance with some embodiments.

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments.

Described herein are processes for providing cosmetically appealing and durable anodic oxide films on metal alloy substrates. Conventional anodizing methods when applied to some metal alloys can result in an anodic oxide film that has cosmetic defects or that is predisposed to delamination. Methods described herein involve post-anodizing treatments that can be used to eliminate or reduce these cosmetic defects and to provide a well-adhered anodic oxide film.

In some embodiments, the methods involve a post-anodizing diffusion promoting process, which are described in detail below with reference to FIGS. 1-8. Alloying elements within metal alloy substrates, such as zinc, copper, manganese, iron and lead, have been shown to accumulate at an interface between the a metal alloy substrate and an anodic oxide film during the anodizing process. These alloying elements enriched at the interface may be associated with a prevalence of delamination and/or discoloration of the anodic oxide film as well as a susceptibility of the metal alloy substrates to corrosion. Methods described herein involve implementing a post-anodizing diffusion promoting process that causes the alloying elements to diffuse away from the interface into the metal alloy substrate and/or into the anodic oxide film. The resulting anodized metal alloy substrates are more resistant to anodic oxide film delamination and less affected by discoloration compared to untreated anodized metal alloy substrates.

The diffusion promoting processes can involve directly heating the part. The heat can relieve residual stress at the interface and homogenize or diffuse the alloying elements away from the interface. It should be noted that heating of an anodized part is conventionally frowned upon since doing so under some conditions can cause the protective anodic oxide film to crack or craze, or can be detrimental to the mechanical performance of heat sensitive alloy tempers. However, since the interface in which the alloying elements are enriched is very small—on the order of nanometers, the amount of thermal energy required to cause sufficient diffusion can be relatively small. Thus, the applied temperatures can be relatively low—low enough to reduce the risk of cracking of the anodic oxide film and to avoid any microstructural change in the alloy.

In some cases, thermal energy is applied locally to surface portions of the anodized part, such as by way of lamps or lasers, while leaving remainder portions of the anodized part cool, or cooling the remainder portions of the anodized part. This can minimize heat treatment of the metal (avoiding over-aging heat sensitive parts, or any part distortion due to stress relief), and can reduce the occurrence of cracking or crazing of the anodic oxide film. This can also reduce the effects of coefficient of thermal expansion (CTE) differences between the substrate and the anodic oxide film, reducing stresses generated. In some embodiments, the thermal energy is applied during a hydrothermal sealing process where the part is heated in an aqueous solution or steam such that the diffusion of alloying elements away from the interface occurs in the same operation as sealing the anodic oxide film.

In some embodiments, the methods involve post-anodizing aging processes, which are described in detail below with reference to FIGS. 9A-12. Conventional anodizing of metal alloy substrates involves anodizing a metal alloy substrate while in a final age hardened state. In an age hardened state, alloying elements and precipitate particles are situated within the crystal lattice of substrate such that they impede movement of dislocations of the crystal lattice of substrate, thereby strengthening the metal alloy substrate. However, alloying elements and/or precipitate particles tend to aggregate along grain boundaries, which can act as corrosion sites when anodized. This can result in an anodic oxide film having defects in the form of fine grooves along these grain boundaries. Methods described herein involve anodizing the metal alloy substrate while in an age-hardenable state, following by implementing a post-anodizing aging process. The resulting anodized metal alloy substrates have high strength and have an anodic oxide film that is substantially free of grain boundary groove defects.

In some embodiments, aspects of post-anodizing diffusion promoting processes are combined with aspects of the post-anodizing aging processes. For example, in some cases a post-anodizing diffusion promoting process is extended to include and aging process. The processing parameters can be tuned to achieve an anodic oxide film having a predetermined cosmetic quality and an underlying metal alloy substrate having a predetermined strength. Details of these embodiments are described below.

The present paper is illustrated with specific reference to certain aluminum alloy substrates, such as certain aluminum-zinc alloy substrates. It should be understood, however, that the methods described herein can be applicable to the treatment of any of a number of other suitable metal alloys, including aluminum alloy substrates that contain non-zinc alloying elements. In addition, other metal alloy substrates where the metal matrix comprises metals other than aluminum, such as magnesium, titanium or other anodizable alloy materials can also be used. In some embodiments, the metal matrix includes more than one type of anodizable alloy material. As used herein, the terms anodic oxide film, anodic oxide layer, and anodic oxide coating, oxide film, oxide layer, oxide coating can be used interchangeably and can refer to any suitable metal oxide material formed using an anodizing process, unless otherwise specified.

Methods described herein are well suited for providing cosmetically appealing surface finishes to consumer products. For example, the methods described herein can be used to form durable and cosmetically appealing finishes for housing or enclosures for computers, portable electronic devices and electronic device accessories, such as those manufactured by Apple Inc., based in Cupertino, Calif.

These and other embodiments are discussed below with reference to FIGS. 1-12. However, those skilled in the art will readily appreciate that the detailed description given herein with respect to these Figures is for explanatory purposes only and should not be construed as limiting.

The methods described herein can be used to form durable and cosmetically appealing coatings for metallic surfaces of consumer devices. FIG. 1 shows consumer products than can be manufactured using methods described herein. FIG. 1 includes portable phone 102, tablet computer 104 and portable computer 106, which can each include metal surfaces. Devices 102, 104 and 106 can be subject to impact forces such as scratching, dropping, abrading, chipping and gouging forces during normal use. Typically the metal surfaces are anodized in order to add a protective anodic oxide coating to these metal surfaces. However, it has been found that the adhesion strength of the anodic oxide coatings can depend, at least in part, on the type of metal used for the metal surfaces. For example, some stronger aluminum alloys, although they can provide good structural integrity to devices 102, 104 and 106, can also form anodic oxide coatings that are more prone to chipping, scratching and otherwise marring caused by impact forces. In particular, the anodic oxide coatings can have a tendency to chip, spall, blister or delaminate under surface impact, revealing bright spots of the bare substrate alloy that can detract from the cosmetic appearance of devices 102, 104 and 106. Metal surfaces at edges and corners of devices 102, 104 and 106 can be especially vulnerable to this chipping and delamination. In addition, the anodic oxide films of some metal alloys can be discolored, which can detract from cosmetic appeal of devices 102, 104 and 106.

Figure 2A:
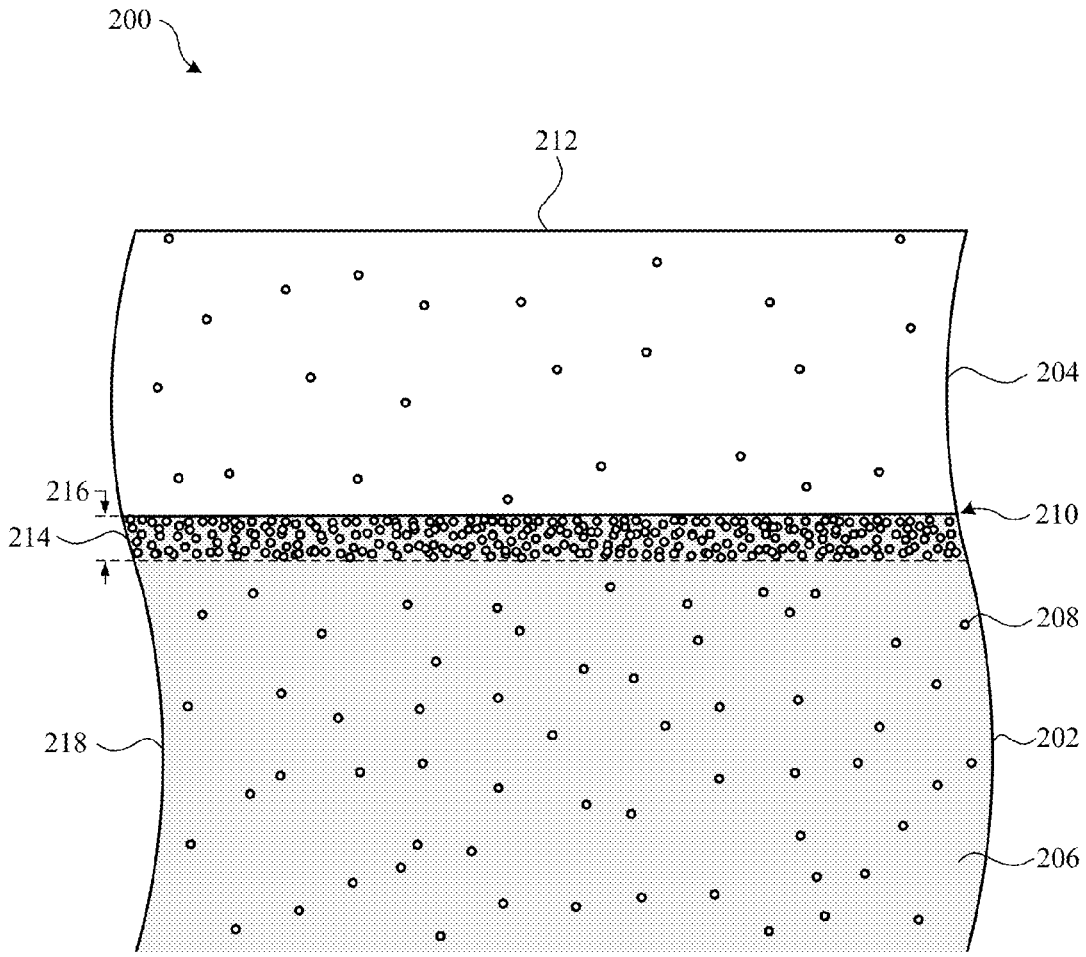
FIG. 2A shows a section view of a surface portion of a part that includes alloying elements enriched at an interface between an anodic oxide film and a substrate of the part.

During the anodizing of metal alloy substrates, such as those forming metal surface of devices 102, 104 and 106, any of a number of alloying elements can have a tendency to become enriched in a thin enrichment layer at the interface of the advancing anodic oxide film and underlying substrate. To illustrate, FIG. 2A shows a section view of a surface portion of part 200, which includes substrate 202 with anodic oxide film 204 formed thereon. Anodic oxide film 204 is formed using an anodizing process where a portion of substrate 202 is converted to a corresponding metal oxide material. Substrate 202 is made of a metal alloy material that includes a metal matrix 206 (e.g., aluminum) with alloying elements 208 dispersed therein.

Alloying elements 208 can advantageously affect the physical properties of substrate 202. For example, alloying elements 208 can induce greater strength and hardness, toughness, ductility or other desired properties to substrate 202. These qualities are generally desirable in many applications and are why metal alloys are used over non-alloy metals. The nature and amount of alloying elements 208 within substrate 202 can vary depending on the metal alloy type. For example, many aluminum alloys, such as some 7000 series types of aluminum alloys, include some amounts of zinc, magnesium, and sometimes copper alloying elements 208. Other typical alloying elements 208 in aluminum alloys can include iron, manganese, silicon, chromium, and titanium. Often, metal alloys include more than one type of alloying element 208.

Although alloying elements provide beneficial qualities to substrate 202 and part 200, anodizing can affect the distribution of alloying elements 208. In particular, during anodizing a portion of alloying elements 208 can become concentrated or enriched within enrichment layer 214 of substrate 202 at interface 210 between anodic oxide film 204 and substrate 202. Enrichment layer 214 can be identified as a region of high concentration of alloying elements 208 surrounding or adjacent to interface 210. In some cases, certain types of alloying elements are preferentially enriched at enrichment layer 214. For example, copper and zinc types of alloying elements 208 of some aluminum alloys tend to get enriched at enrichment layer 214. A major factor in this enrichment is the relative magnitude of the Gibbs free energy for oxidation of alloying elements 208. Aluminum has a more negative Gibbs free energy for oxidation than either zinc or copper. The aluminum will therefore be oxidized preferentially during the initial stages of anodizing, resulting in enrichment of the zinc and/or copper alloying elements 208 until an equilibrium is reached and alloying elements 208 are oxidized at the same rate as the aluminum of aluminum matrix 206.

The thickness 216 of enrichment layer 214 is typically on the order of nanometer scale. In some aluminum alloys containing zinc and copper alloying elements 208, thickness 216 of enrichment layer 214 typically ranges between about 1-2 nanometers, which is scarcely resolvable even by transmission electron microscopy (TEM), and in some cases is not readily quantified. The thickness 216 of enrichment layer 214 may be verified by such techniques as electron energy loss spectroscopy, and XPS of delaminated interfaces. In some aluminum alloy substrates 202, copper alloying elements 208 can be enriched within enrichment layer 214 by about 40 weight percent, even in aluminum alloys with as little as 0.2 weight percent of copper in bulk (as alloying element in aluminum alloy). Similarly, zinc alloying elements 208 can become enriched within enrichment layer 214 by about 3 weight percent. Note that many other alloying elements 208 can become enriched due to preferential oxidation of an aluminum matrix 206 and are not just limited to copper and zinc. These can include iron, titanium, chromium, molybdenum, gold and silver.

As described above, it has been found that anodic oxide films formed on certain metal alloy substrates are prone to delamination and discoloration because of the presence of alloying elements 208 at interface 210. For example, during anodizing of certain zinc-containing aluminum alloy substrates, notably some types of 7000 series aluminum alloys, significant zinc enrichment occurs at enrichment layer 214. After anodizing in sulfuric acid-based electrolytes, this zinc-rich interface is especially weak, and subject to delamination when exposed to mechanical stress. This is believed due to zinc enriched at or near interface 210 combining with sulfur-containing species from the sulfuric acid-based anodizing electrolytic bath to form delaminating compounds at interface 210. In some cases, it is possible that the zinc can combine with phosphorus-containing species of phosphoric acid anodizing electrolytes to from other types of delamination compounds. These delaminating compounds weaken the bonding between anodic oxide film 204 and substrate 202 and make anodic oxide film 204 prone to delamination. Other alloying element 208 other than zinc may also detrimentally affect the cohesion of anodic oxide film 204 to substrate 202.

If part 200 suffers from poor interfacial adhesion of anodic oxide film 204 to substrate 202, this condition can lead to a number of problems. For example, anodic oxide film 204 can have a tendency to spall, chip or otherwise delaminate from substrate 202, especially when part 200 is subjected to impacts. This can be detrimental to the appearance of anodized part 200. In addition, the chipped or delaminated areas can expose portions of substrate 202 to water and air in the environment, which can subject these exposed portions to corrosion. The amount of corrosion will depend on the type of alloy that substrate 208 is made of, the amount of delamination and exposure of substrate 202, and the extent of exposure to air and water.

Corrosion may also be a problem in certain manufacturing processes wherever mechanical operations such as drilling or machining are performed after anodizing, exposing an edge of the oxide/metal interface. In such cases, weak interfacial adhesion, combined with the exposure of both the substrate and the enrichment layer (which constitute a pair of dissimilar metals and suffer consequent galvanic interactions)—especially in the presence of cutting fluids and other metals used in tooling—can result in severely accelerated local corrosion and delamination. The present paper describes methods for overcoming this localized corrosion by minimizing or eliminating the interfacial enrichment layer and the corresponding galvanic pair.

Discoloration can be particularly problematic in aluminum alloy substrates that include copper alloying element 208, where as little as one weight percent of copper in the aluminum alloy can result in a distinctly yellow appearance in anodized part 200 following typical Type II sulfuric acid anodizing processes. Type II sulfuric anodizing conventionally refers to an anodizing treatment used to provide relatively colorless anodic oxide films and that is generally performed in a sulfuric acid based electrolyte. Thus, in cases where anodic oxide film 204 is formed using a Type II sulfuric anodizing process and is substantially clear and transparent (when non-dyed), interface 210 will be clearly observed through anodic oxide film 204. On substrates that are made of substantially pure aluminum (i.e., does not contain sufficient amounts of alloying elements 208 to cause discoloration) the appearance of the substantially pure aluminum substrate 208 is retained. However, if interface 210 has a yellow appearance due to the presence of copper alloying elements 208 at interface 210, part 200 will also have a yellow hue as viewed from surface 212. This yellow hue may be undesirable in certain applications.

Discoloration can occur when alloying elements 208 other than copper are present. However, it has been found that wherever copper is present in an aluminum alloy, even in very low concentrations, enrichment of the copper alloying elements 208 at interface 210 can result in a yellow discoloration. Similar types of discoloration occur in aluminum alloy substrate with iron or manganese alloying elements 208. For example, iron and manganese can lead to discolorations having yellow or brown hue. Zinc alloying elements 208 can impart a blue hue. In general, the amount of discoloration is directly related to an amount of certain alloying elements 208 within enrichment layer 214. The amount of discoloration that is deemed acceptable will depend on a number of factors including the type of alloying elements 208 that are present within enrichment layer 214 and an amount of acceptable discoloration based on application requirements. For example, according to some application requirements it may be acceptable, or even preferential, to have a blue hue but less acceptable to have a yellow hue, or vice versa.

In some cases, the enrichment of alloying elements 208, such as zinc or copper, within enrichment layer 214 can be an unavoidable consequence of anodic oxide growth using Type II anodizing processes that is not overcome by chemical pre-treatments. Even if the surface of the aluminum substrate 202 shows no alloying element enrichment at the point of entry into the anodic oxidation process, preferential growth of aluminum (or magnesium oxides), leads to the immediate enrichment of other less readily oxidized metals (e.g., copper and zinc), and high levels of alloying element 208 interfacial enrichment will result within minutes.

To address these issues, the methods described herein involve treatments whereby alloying elements are driven away from interface 210. In particular, methods involve reducing the amount of alloying elements 208 within enrichment layer 214 at the interface 210. This can involve a diffusion promoting process whereby thermal energy is applied to part 200 such that alloying elements 208 are diffused away from enrichment layer 214 and interface 210. In accordance with Fick's law, the diffusive flux goes from regions of high concentration (enrichment layer 214) to regions of low concentration (surrounding anodic oxide film 204 and/or substrate 202) across a concentration gradient. The diffusive action can be driven by the addition of thermal energy by either directly heating part 200, or portions of part 200, or by exposing part 200 to light that is transformed to thermal energy within part 200. Detailed descriptions of different types of systems suitable for performing diffusion promoting processes are described below with respect to FIGS. 3-5.

Figure 2B:
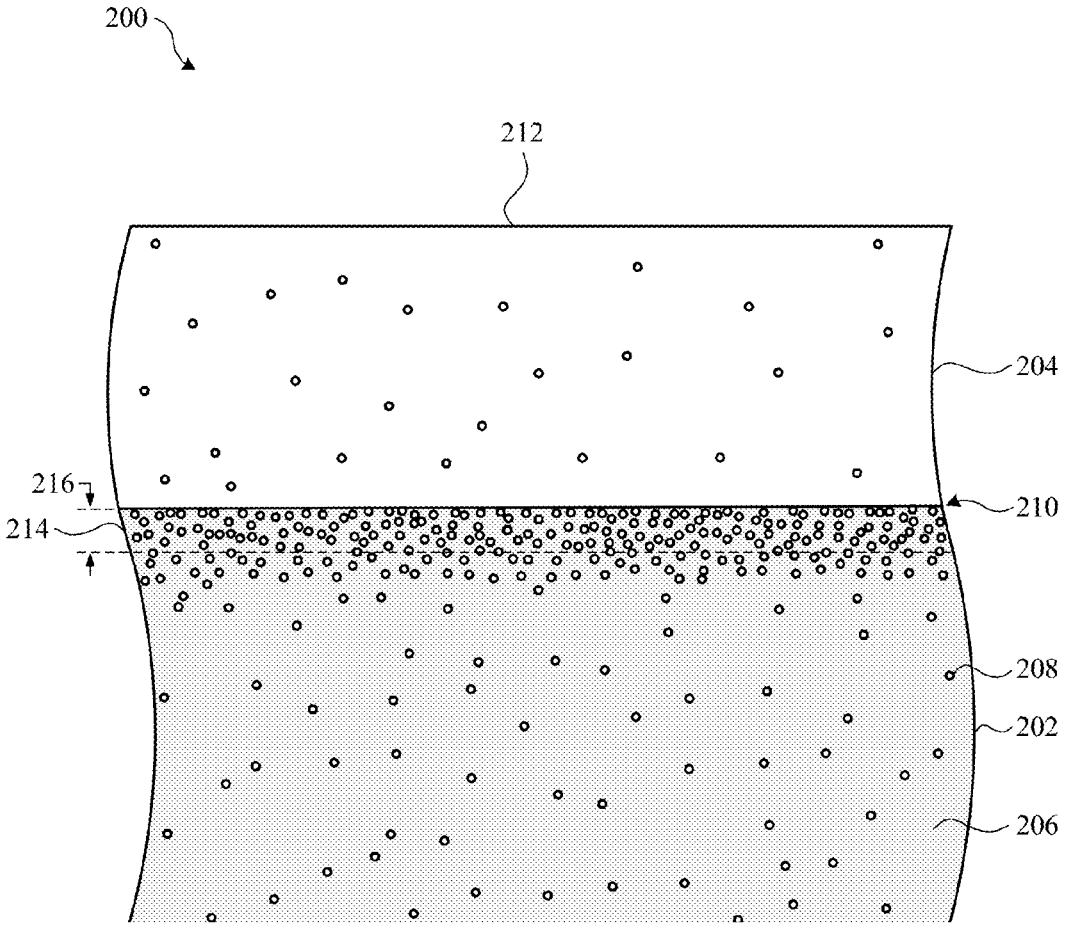
FIGS. 2B-2D shows section views of the part in FIG. 2A after a series of diffusion promoting process that reduce an amount of alloying elements at the interface, in accordance with some embodiments.
Figure 2C:
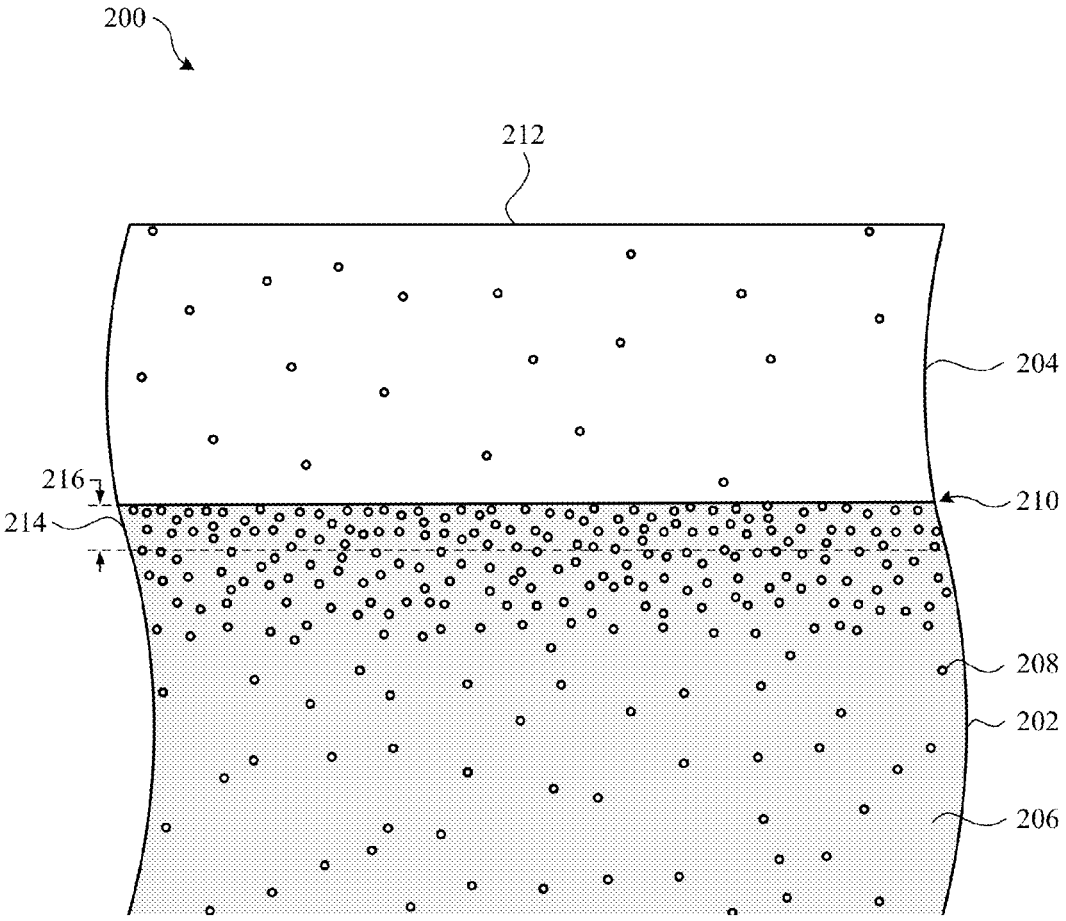
Figure 2D:
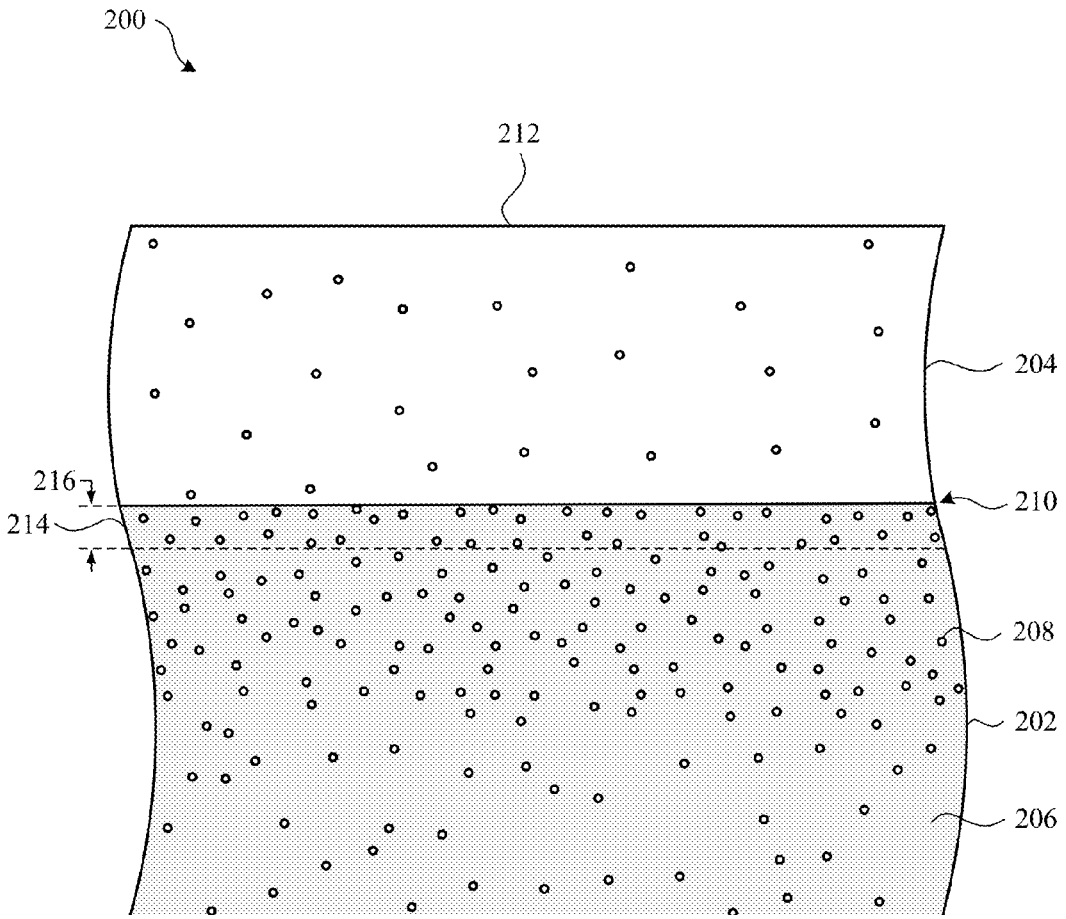

FIGS. 2B-2D show part 200 after different amounts of exposure to one or more diffusion promoting processes. FIG. 2B shows part 200 after exposure to a diffusion promoting process for a first time period. As shown, the amount or concentration of alloying elements 208 within enrichment layer 214 and at interface 210 is reduced. This is due to the movement and redistribution of alloying elements 208 from enrichment layer 214 into surrounding areas of anodic oxide film 204 and/or substrate 202 that have lower concentrations of alloying elements 208. In a particular embodiment wherein substrate 202 is a zinc-containing aluminum alloy substrate 202 and part is exposed to temperatures of about 100 degrees C. for about 15 minutes, the diffusion distance away from enrichment layer 214 is calculated to be about 0.77 nm. Note that FIG. 2B (as well as FIGS. 2C and 2D described below)

shows most or all of alloying elements 208 diffusing within substrate 202. It should be understood, however, that diffusion may also occur within anodic oxide film 204, or within both anodic oxide film 204 and substrate 202.

Since the concentration of alloying elements 208 within enrichment layer 214 is reduced, one or more of the associated negative effects is also reduced. For example, the adhesion strength between anodic oxide film 204 and substrate 202 is increased proportionally to the reduced concentration of alloying elements 208 within enrichment layer 214. This directly reduces the likelihood of chipping and otherwise delamination of anodic oxide film 204 from substrate 202. In addition, any discoloration caused by the presence of alloying elements 208 at interface 210 as viewed from surface 212 is proportionally decreased. Thus, if substrate 202 is an aluminum alloy containing copper alloying element 208, the concentration of copper alloying element 208 at interface region 210 can be reduced enough such that part 200 does not appear yellow or has an acceptable amount of yellow appearance. In some embodiments, substantially all the discoloration is removed such that anodic oxide film 204 is substantially transparent and allows an un-tinted view of the color of substrate 202.

In other embodiments, the amount of discoloration is reduced to a predetermined amount that is deemed acceptable. This can be determined by measuring the color of part 212 as viewed from surface 212 after the diffusion promoting process is performed using a colorimeter or other suitable technique. In a particular embodiments, the measurement includes a one or more values in L*a*b* color space (or CIELAB). L*a*b* color space is a model used to plot colors of an object according to color opponents L* corresponding to an amount of lightness or brightness, a* corresponding to amounts of green and magenta, and b* corresponding to amounts of blue and yellow. Negative a* values indicate a green color while positive a* values indicate a magenta color. Negative b* values indicate a blue color and positive b* values indicate a yellow color. Thus, part 200 can be evaluated for L*a*b* values corresponding to blue, yellow, green and/or magenta after the diffusion promoting process to determine whether the part has achieved a predetermined L*, a*, and/or b* value(s). For example, the acceptable amount of discoloration can correspond to an acceptable amount of yellow, blue, green or magenta color. In a particular embodiment where substrate 202 is an aluminum alloy having copper alloying elements 208, a b* value to determine an acceptable amount of yellow is measured.

In some cases, further diffusion away from interface 210 is desired. FIG. 2C shows part 200 after exposure to the diffusion promoting process for an additional second time period. As shown, the amount or concentration of alloying elements 208 within enrichment layer 214 and at interface 210 is further reduced due to further diffusion of alloying elements 208. In a particular embodiment wherein substrate 202 is a zinc-containing aluminum alloy substrate 202 and part is exposed to temperatures of about 100 degrees C. for a total of about 60 minutes, the diffusion distance away from enrichment layer 214 is calculated to be about 1.5 nm. The bond strength between anodic oxide film 204 and substrate 202 is proportionally increased and any discoloration caused by the presence of alloying elements 208 near or at interface 210 as viewed from surface 212 is proportionally decreased.

If it is determined that the amount of alloying elements at interface 210 is still too high, part 200 can be further exposed. FIG. 2D shows part 200 after exposure to the diffusion promoting process for an additional third time period. As shown, the amount or concentration of alloying elements 208 within enrichment layer 214 and at interface 210 is further reduced. In a particular embodiment wherein substrate 202 is a zinc-containing aluminum alloy substrate 202 and part is exposed to temperatures of about 100 degrees C. for a total of about 120 minutes, the diffusion distance away from enrichment layer 214 is calculated to be about 2.2 nm. The bond strength between anodic oxide film 204 and substrate 202 is proportionally increased and any discoloration caused by the presence of alloying elements 208 near or at interface 210 as viewed from surface 212 is proportionally decreased.

Alloying elements 208 can be further diffused away from interface 210 by exposing part 200 the diffusion promoting process for even additional time periods or to a different type of diffusion promoting process. In this way, the amount of diffusion can be chosen to accomplish a predetermined desired bond strength and/or color for part 200. The extent to which alloying elements 208 are diffused will depend on the diffusion technique (e.g., direct heating or exposure to light), the intensity of the heat and/or light exposure, the time period of exposure, the amount and type of alloying elements 208, as well as the metal alloy material of substrate 202. In general, the higher the thermal energy that is applied, the faster diffusion will occur. For example, heating substrate 202 at 150 degrees C. compared to 100 degrees C. will result in alloying elements 208 diffusing within bulk portion 218 at a faster rate. In a particular embodiment wherein substrate 202 is a zinc-containing aluminum alloy substrate 202 and part is exposed to temperatures of about 150 degrees C. for a total of about 15 minutes, the diffusion distance away from enrichment layer 214 is calculated to be about 7.12 nm, and continuing to heat substrate 202 at 150 degrees C. for a total of 60 minutes is calculated to diffuse zinc alloying elements 208 a distance of about 14.24 nm.

Figure 3:
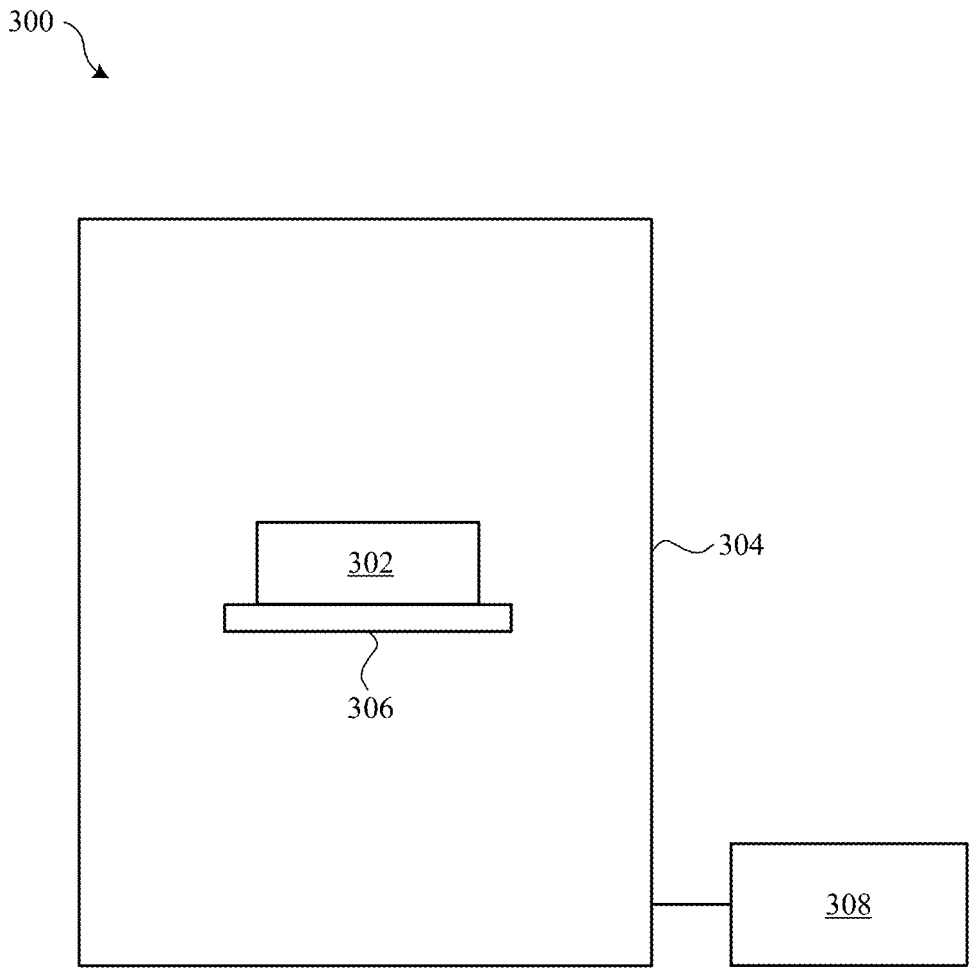
FIG. 3 shows a schematic view of an oven system for performing a diffusion promoting process on a part, in accordance with some embodiments.
Figure 4:
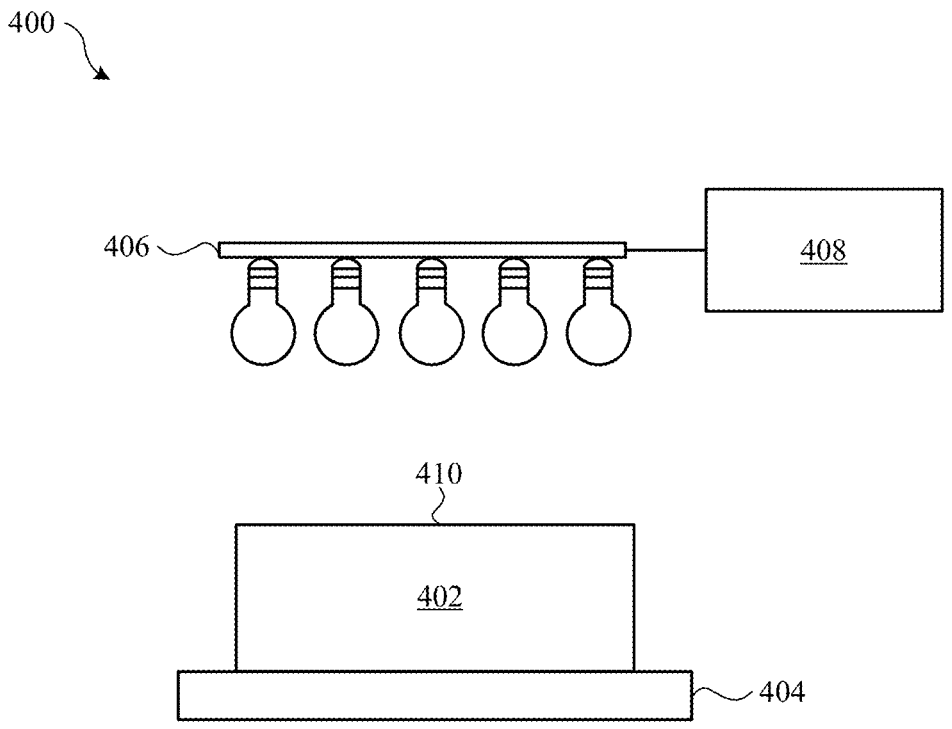
FIG. 4 shows a schematic view of a system configured to apply localized energy to a surface of a part as part of a diffusion promoting process, in accordance with some embodiments.
Figure 5:
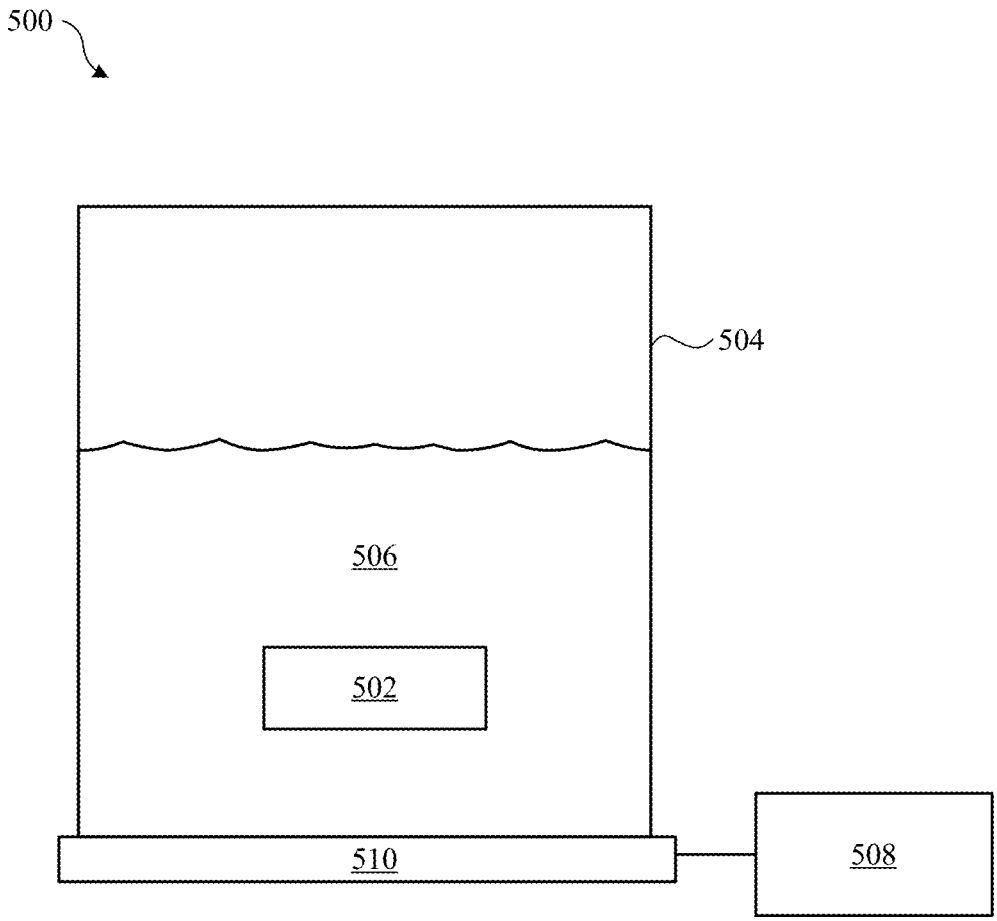
FIG. 5 shows a schematic view of liquid heating system for performing a diffusion promoting process on a part, in accordance with some embodiments.

As described above, the manner in which the diffusion promoting process is carried out can vary. In some embodiments, the diffusion promoting process involves one or more direct heat treatments. In some cases, the diffusion promoting process involves one or more irradiation operations. In some embodiments, a combination of heat treatment(s) and irradiation operation(s) are used. Choosing an appropriate diffusion promoting process will depend on the nature of substrate 202 and anodic oxide film 204 and on application requirements. For example, it may be important to minimize over-aging of an alloy, or to ensure that anodic oxide film 204 does not crack or craze during the diffusion promoting process. The cracking or crazing can be partially due to the different thermal expansion coefficients of substrate 202 and anodic oxide film 204. That is, exposure to high temperatures can cause substrate 202 to expand more than anodic oxide film 204, causing stress within anodic oxide film 204 and possibly causing anodic oxide film 204 to crack. Therefore, in some embodiments, the thermal methods should generally be relatively mild. FIGS. 3-5 show different systems that can be used to apply thermal energy to a part for inducing diffusion of alloying elements in accordance with described embodiments.

FIG. 3 shows a schematic view of an oven system 300 for applying thermal energy to part 302, in accordance with some embodiments. System 300 includes chamber 304 suitable for accommodating part 302 therein. At least a portion of part 302 includes a metal alloy substrate with an anodic oxide film formed on a surface of the metal alloy substrate. System 300 is arranged to provide sufficient thermal energy to part 302 to diffuse away enriched alloying elements from an interface between the metal alloy substrate and the anodic oxide film. In some embodiments, support 306 supports and positions part 302 within chamber 304. Oven system 300 includes one or more heat sources that supply heat within chamber 304 such that part 302 can be heated when positioned therein. Controller 308 can be electrically coupled with a temperature sensor, such as a thermocouple, to control a temperature within chamber. In some cases, a temperature sensor is used to directly monitor a surface temperature of part 302.

In some embodiments, it is preferable that conditions within chamber 304 are substantially dry in order to prevent sealing of the anodic oxide film of part 302. Sealing of anodic oxide films can occur in the presence of water at temperatures above about 60 degrees C. In some embodiments, chamber 304 includes an air environment. Note that if moisture-free conditions are preferred, it may be important to dry part 302 prior to applying the heat treatment otherwise the residual moisture on surfaces of part 302 can also cause the anodic oxide film to seal. The drying of part 302 prior to the heat treatment can include an air dry procedure whereby surfaces of part 302 are allowed to dry at room temperature. In general, however, it is acceptable to dry parts at higher temperatures under forced air circulation as there is insufficient moisture retained on the surface or within pores to cause significant sealing.

As described above, it may be important to keep the temperatures within chamber 304 and of part 302 below a temperature but high enough to cause efficient thermal diffusion. Because the thickness of an enrichment layer at the interface is generally only about 1 to 2 nanometers, the heat treatment need only promote diffusion of the alloying elements on a scale of a few nanometers. However, the temperature should be high enough to promote diffusion within a time period consistent with a manufacturing process. For example, it may be possible to heat part 302 to a temperature that causes adequate diffusion over a period of days, which may not be suitable for a manufacturing process.

The range of suitable temperatures can vary depending on the material of part 302. In some embodiments using an aluminum alloy substrate with a standard Type II anodic oxide film, optimal results are obtained using temperatures of about 150 degrees C. or more. In particular embodiments, heat treatment at about 150 degrees C. for about 1 hour is sufficient to redistribute zinc alloying element to the extent that the standard Type II anodic oxide films show a measurable and significant benefit with regard to the adhesion of the anodic oxide film. In a particular embodiment, part 302 is heated to a temperature of about 150 degree C. for about 15 minutes. In some embodiments, a temperature ranging from about 200 degrees C. and 300 degrees C. is used. Note that temperatures ranging between about 100 degrees C. and about 150 degrees C. can be used; however, these lower temperatures would require longer exposure times to provide adequate diffusion. In some cases, part 302 is placed into chamber 304 while chamber 304 is at a lower temperature and then the temperature is ramped up to a predetermined temperature. In other embodiments, part 302 is placed into chamber 304 after the temperature within chamber 304 is at the predetermined temperature.

Although diffusion of the alloying elements away from the interface can both increase adhesion strength and mitigate discoloration, in some cases the heat treatments may be designed to focus on mitigating the discoloration rather than focusing on improving adhesion. In these cases, appropriate temperatures can depend on the type of alloying elements. For example, enriched zinc in zinc-containing alloys can impart a blue hue to the anodic oxide film. The heat treatments described herein can reduce the blue hue, thereby allowing a clearer view of the bright silver color of the underlying aluminum. Other alloying elements such as copper, manganese and iron can also lead to discolorations of anodized aluminum surfaces, in particular, a yellow or brown hue. Copper and manganese have lower diffusivities within an aluminum matrix of the aluminum alloy substrate compared to zinc, and therefore generally require higher temperatures and longer times for diffusion away from the interface. Thus, in these cases temperatures well above 150 degrees C. are preferable in order to provide efficient diffusion.

In some embodiments, the temperature is forcibly cooled from an opposing surface of part 302 so as to establish a steep thermal gradient thus minimizing the differential thermal expansion and resulting strain, or to maintain the bulk of the sample at a lower temperature to minimize any detrimental effects of heat treatment on the alloy. Forcible cooling can be accomplished by placing part 302 on a cool surface or by blowing cool air on part 302. In some embodiments, it is preferable to focus on providing thermal energy to surface portions of the part since the interface is directly beneath the anodic oxide film of the part. FIG. 4 shows a schematic view of a system 400 for applying localized thermal energy to a surface 410 part 402, in accordance with some embodiments. System 400 includes energy source 406, which can include one or more elements that are configured to direct energy localized to surface 410 of part 402. In some embodiments, energy source 406 includes one or more light-producing elements configured to shine light onto surface 410. In some embodiments, part 402 is supported by and/or positioned with respect to energy source 406 using support 404. Controller 408 can be used to turn energy source 406 on and off and, in some cases, control the intensity of light produced by energy source 406. In some embodiments, the temperature of part 402 is monitored during a thermal diffusion process using a temperature sensor, such as a thermocouple, to assure that part 402 does not pass a predetermined temperature.

Light produced by energy source 406 and shone on part 402 should be intense enough to induce diffusion of alloying elements away from the interface within a suitable amount of time, as specified by particular process requirements. However, the light energy should not be so intense as to damage surface portions of part 402, such as by inducing cracks within the anodic oxide film of part 402. In some embodiments, wavelengths of light produced by energy source 406 are in the infrared (IR) or near IR spectrum. Energy source 406 can be in the form of one or more heat lamps, or in the form of a laser that is tuned to produce a desired light wavelength. In some cases it may be beneficial to perform a light exposure prior to a dyeing process to assure that the anodic oxide film does not contain substantially any light absorbing compounds that can block the light from efficiently diffusing the alloying elements away from the interface. Conversely, dark dyestuffs within the anodic oxide may help absorb radiation and enhance the local heating of the oxide, achieving more efficient heating.

Note that since energy source 406 can localize energy to surface 410 of part 402, portions of the underlying substrate of part 402 can remain relatively cooler than the surface portions. This can prevent problems associated with the different thermal expansions of the substrate and the anodic oxide film. Thus, by keeping the bulk of substrate cool, this will keep the bulk of substrate from heating up and expanding faster than the expansion of the adjacent anodic oxide film. In some embodiments, support 404 includes a cooling element that keeps portion of the substrate cooler than surface 410 of part 402 during the light exposure. Because the heat is localized to surface portions of part 202, it may be possible to achieve localized higher temperatures at the surface part 402 than if the entire part 402 were heated. For example, it may be possible to heat the surface of part 402 to temperatures well above 150 degrees C. without heating the bulk substrate of part 402 to such temperatures, thereby reducing the risk of causing the bulk substrate of part 402 to over-age and soften. If support 404 has a cooling mechanism, this cooling can keep the bulk substrate of part 402 well below these high temperatures that can cause over-aging. In some cases, the surface of part 402 reaches temperatures of ranging between about 200 and about 300 degrees C., or greater. These localized higher temperatures can provide shorter exposure times for sufficient alloying element diffusion. For example, sufficient diffusion can occur in the order of minutes using temperatures of about 200 and 300 degrees C. compared to an hour or hours with temperatures of about 150 degrees C.

Another method of supplying thermal energy to a part involves immersing the part in a heated liquid. FIG. 5 shows a schematic view of a liquid heating system 500 for applying thermal energy to part 502, in accordance with some embodiments. Liquid heating system 500 includes tank 504 suitable for containing liquid 506 as well as part 502. Heater 510 can be configured to heat liquid to a predetermined temperature as controlled by controller 508. Tank 504 can include a temperature sensor, such as a thermocouple, that can monitor the temperature of liquid 506 during a thermal diffusion process.

In some embodiments, liquid 506 is substantially free of water so as to prevent hydration and sealing of the anodic pores within the anodic oxide film of part 502. Suitable liquids 506 may include organic-based liquids. During the thermal diffusion process, part 502 is immersed within liquid 506, which is heated to a temperature sufficiently high to induce diffusion of alloying elements away from the interface of part 502. As described above, desired temperatures can vary depending on the metal alloy of part 502, the types of alloying elements, a desired adhesion strength and/or desired amount of discoloration, or even the desired final temper of the substrate (where the heat treatment is being used to age the alloy, as described later in this paper), as well as identification as to acceptable time periods for the diffusion process within a manufacturing process. In some embodiments, the temperature of liquid 506 is held at temperatures of about 150 degree C. or higher. In some cases, part 502 is exposed to a gaseous form or liquid 506. That is, liquid 506 is heated above a boiling point of liquid 506 such that part 502 is also immersed in a gaseous form of liquid 506.

As described above, in some embodiments the diffusion promoting process occurs in parallel with a hydrothermal sealing process, so as to avoid the need for additional process steps or equipment. In these embodiments, liquid heating system 500 can be configured to perform the diffusion promoting process with a sealing process. In particular, tank 504 can be configured to hold a liquid 506 that is aqueous. The aqueous liquid 506 can be any type of aqueous liquid suitable for anodic oxide pore sealing. In a particular embodiment, liquid 506 includes nickel acetate. Conventional sealing operations use temperatures ranging from about 100 degrees C. or lower for about less than one hour—most typically between 15 and 45 minutes. However, such relatively low temperatures may require long exposure times in order to cause sufficient diffusion of alloying elements, in some cases several hours (e.g., 4 or 5 hours) or longer. To speed up the diffusion, liquid 506 can be heated to higher than used in typical sealing operations. For example, liquid 506 can be heated to about 150 degrees C. or higher over a period of a few hours or less. Such temperatures are nominally more than sufficient to cause sealing and can provide enough thermal energy to cause diffusion of alloying elements away from the interface of part 502. Temperatures well above 150 degrees C. can be used to shorten the exposure times.

Figure 6:
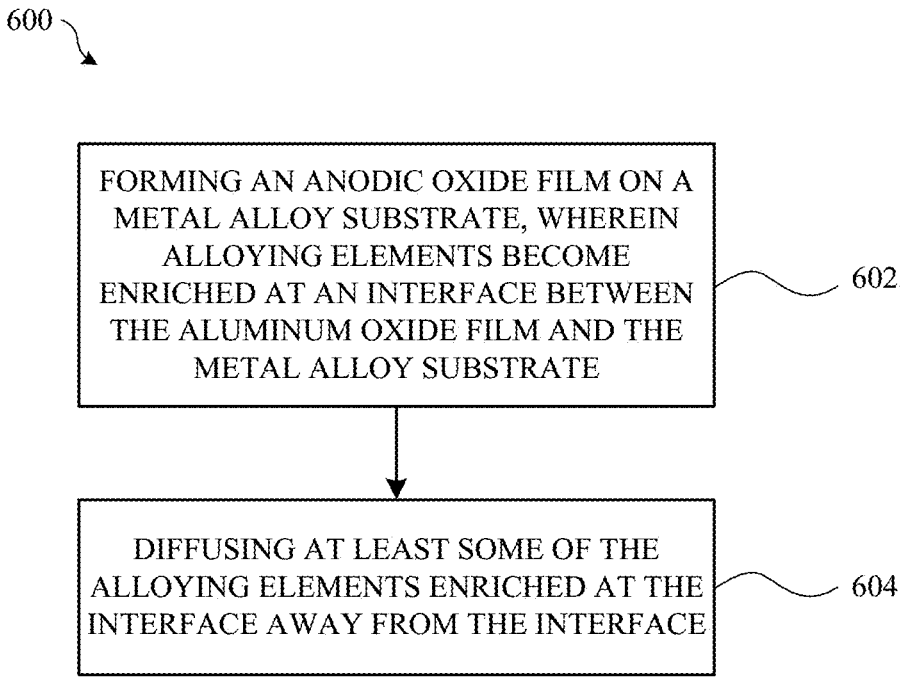
FIG. 6 shows a flowchart indicating a high level process for diffusing promoting process, in accordance with some embodiments.

FIG. 6 shows flowchart 600 indicating a high level process for performing a diffusing promoting process on a part, in accordance with described embodiments. At 602 an anodic oxide film is formed on a metal alloy substrate by anodizing the metal alloy substrate. Alloying elements from the metal alloy substrate are enriched at an interface between the metal alloy substrate and the anodic oxide film during an anodizing process. The alloying elements enriched at the interface can be associated with a reduced adhesion strength between the anodic oxide film and the metal alloy substrate, an amount of discoloration of the part, or both.

At 604, at least some of the alloying elements enriched at the interface are diffused away from the interface. The alloying elements can diffuse toward one or both of the metal alloy substrate and the anodic oxide film. The resulting part has an increased adhesion strength, reduced amount of discoloration, or both. In some embodiments, the discoloration is reduced to a predetermined amount, such as an acceptable level of yellow, blue, green and/or magenta as measured using L*a*b* color space model techniques.

Figure 7:
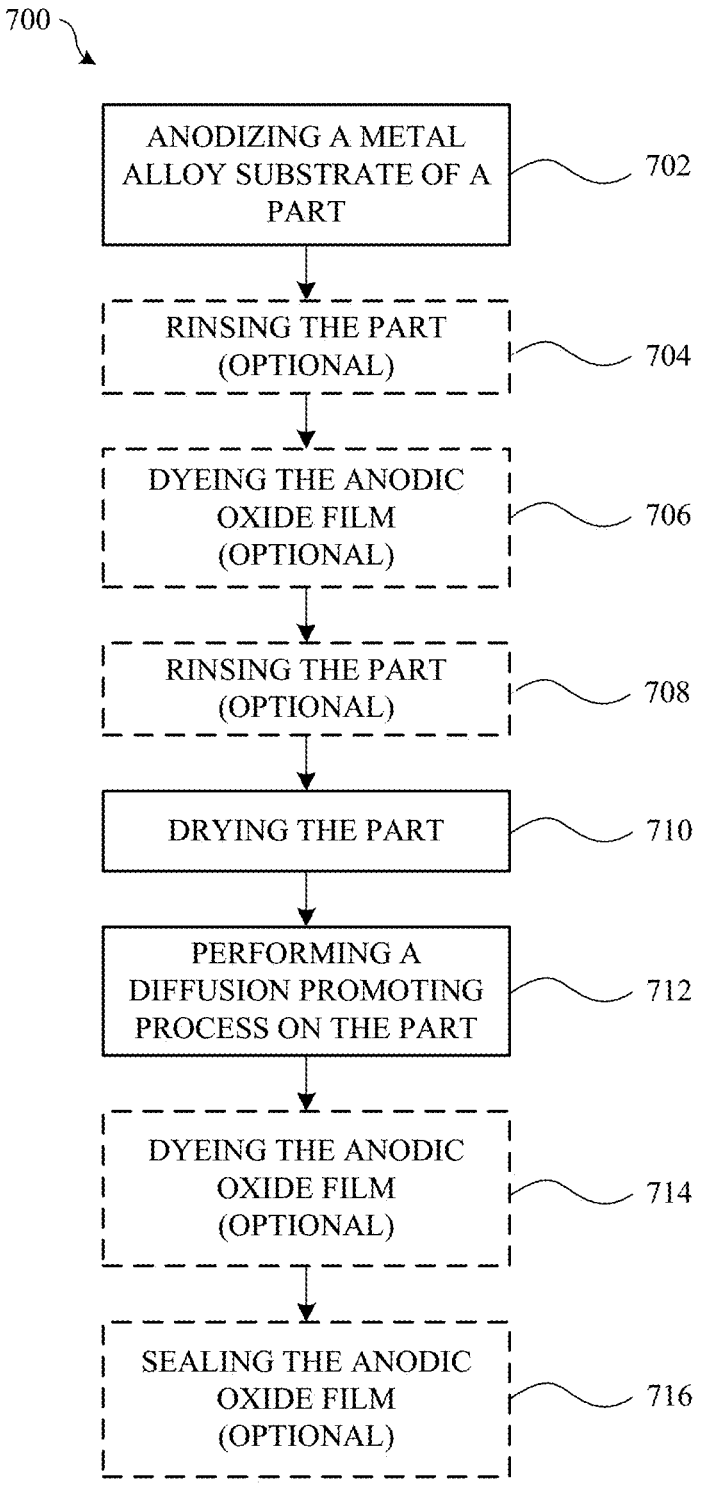
FIGS. 7 and 8 show flowcharts indicating manufacturing processes that include diffusion promoting processes, in accordance with some embodiments.
Figure 8:
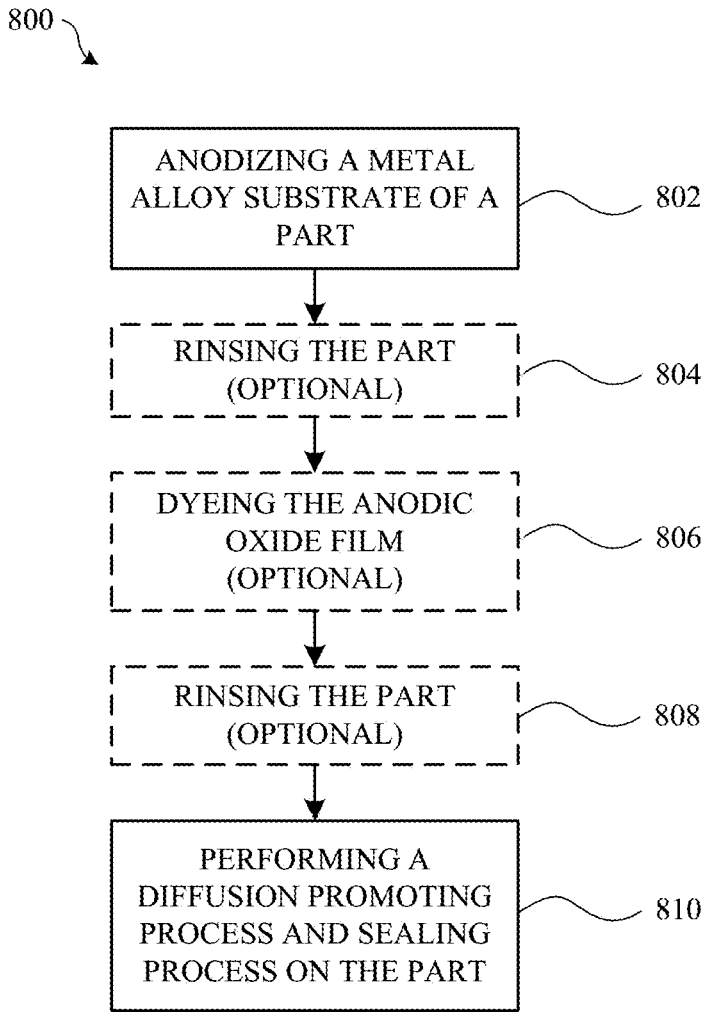

As described above, it may be important to perform the diffusion promoting process before certain operations of a manufacturing process. For instance, typical post-anodizing processes include a sealing process, which involves sealing or closing the anodic pores within an anodic oxide film. Once sealed, the anodic oxide film is stiffer and therefor can be more prone to cracking. Thus, in some embodiments, it is preferable to apply the thermal diffusion processes prior to or in parallel with a sealing process and while the anodic oxide film is still relatively compliant. Because the unsealed anodic oxide film is relatively compliant compared to a sealed anodic oxide film, it experiences a lower stress for a given thermally-induced strain (the result of differential thermal expansion between high CTE metal substrates and relatively low CTE oxide), remaining below its tensile limit even at temperatures as high as 250 degrees C., and is therefore less susceptible to cracking than a sealed anodic oxide films. In addition, it may also be preferable to perform certain thermal diffusion treatment prior to some dyeing operations, especially if the dye is adversely affected by the thermal diffusion treatment. In other cases where the dye is not significantly adversely affected by the temperatures of the thermal diffusion treatment, the substrate is subject to a dyeing operation prior to the thermal diffusion treatment. FIGS. 7 and 8 shows flowcharts indicating different manufacturing process that include diffusion promoting processes, in accordance with some embodiments.

FIG. 7 shows flowchart 700 indicating one manufacturing process. At 702, a metal alloy substrate of the part is anodized forming an anodic oxide film on the metal alloy substrate. Prior to anodizing, the part can be shaped using any suitable shaping operations including suitable machining, extruding, etching, polishing and/or buffing operations. During the anodizing, alloying elements from the metal alloy substrate become enriched at an interface between the anodic oxide film and the metal alloy substrate. In some embodiments, the anodizing process can be modified to reduce the amount of alloying elements from accumulating at the interface. In some embodiments, a Type II anodizing process in sulfuric acid is performed, thereby creating a relatively transparent anodic oxide film. In a particular embodiment, a Type II anodizing process using an electrolytic bath including a sulfuric acid concentration of about 150 g/L to about 150 g/L, with an anodizing voltage ranging from about 8 volts to about 20 volts, with a current density ranging from about 0.5 $A/dm^2$ to about 2.5 $A/dm^2$ is used, producing an anodic oxide film having a thickness of between about 10 micrometers to about 20 micrometers.

At 704, the part is optionally rinsed using, for example, deionized water, to remove the anodizing bath solution from surfaces of the part. The rinsing process can also include a separate pore cleaning rinse using, for example, a three-minute immersion in dilute nitric acid solution to remove some material from within the pores. At 706, the anodic oxide film is optionally dyed to impart a desired color to the anodic oxide film. Any suitable dyeing process can be used, including infusion of organic or inorganic dyes (or both) within the anodic pores of the anodic oxide film. If dyeing is performed at this stage, the type of dye(s) used should be resistant to degradation when subject to the thermal energy of the subsequent diffusion promoting process. At 708, the part can be optionally rinsed again to remove dye remnants.

At 710, the part is dried to remove water from the part that can otherwise cause sealing of the pores during the subsequent diffusion promoting process. In some embodiments, the drying process involves allowing water to evaporate from the part in air at room temperature. The amount of time for the drying process will depend on the amount of moisture within the air. In normal conditions, the air drying can occur over a period of an hour or more. In some embodiments, the part is exposed to a substantially moisture-free environment, such as under nitrogen. At 712, a diffusion promoting process is performed to diffuse the alloying elements away from the interface. The diffusion promoting process generally involves applying thermal energy to at least a portion of the part, as described above. The diffusion promoting process can include exposing the part to one or more heating processes, as described above, until a desired color of the part and/or adhesion strength between the anodic oxide film and the substrate is/are achieved.

Once the alloying elements are sufficiently diffused away from the interface, at 714 the anodic oxide film is optionally dyed. If a prior dyeing process was performed (at 706), the dyeing process at 714 constitutes an additional dyeing process. In some embodiments, the same dye(s) are infused as used in the dyeing process 706, while in other embodiments different dye(s) are infused compared to the dye(s) used in dyeing process 706. In other embodiment, the dyeing process at 714 constitutes a first dyeing process. At 716, the anodic pores of the anodic oxide film are optionally sealed. The sealing process can make anodic oxide film less susceptible to taking on dirt, grease, fingerprints, etc. In some embodiments a hydrothermal sealing process is used. In other embodiments it is preferable to use a "cold" sealing process in order to seal the anodic oxide film without a risk of cracking/crazing the anodic oxide film. Note that since thermal diffusion promoting process at 712 occurs prior to sealing process 716, the thermal diffusion process 712 can be performed with less risk of cracking the anodic oxide film. This is because sealed anodic oxide films are generally stiffer once the voids within the pores are filled due to the hydrating process of sealing. For example, hydration of aluminum oxide film of an aluminum alloy substrate creates various forms of aluminum hydroxide, which fill the pores of the aluminum oxide film.

FIG. 8 shows flowchart 800 indicating an alternative manufacturing process. At 802, a metal alloy substrate of the part is anodized forming an anodic oxide film on the metal alloy substrate. As described above with respect to FIG. 7, the anodizing process can be any suitable process, including a Type II anodizing process. At 804, the part is optionally rinsed to remove residues related to the anodizing process and/or. In some cases pore cleaning process is used to clean the pores of anodic oxide film. At 806, the anodic oxide film is optionally dyed using one or more suitable dyes. At 808, the part is optionally rinsed again to remove residues related to the dyeing process.

At 810, the part is exposed to a diffusion promoting process that is performed in parallel with a sealing process. A greater input of thermal energy is required than that of a conventional sealing process—this may simply be achieved by extending an otherwise conventional sealing process immersion time to several hours. In some embodiments, a modified sealing process can be used that involves exposing the part to a heated aqueous sealing solution or gas (steam) at temperatures that are higher than conventional sealing processes, as described above with reference to FIG. 5. In some embodiments, the temperature of the sealing solution/gas is greater than about 150 degrees C. An advantage of using the process indicated by flowchart 800 is that the diffusion promoting process and sealing process are performed in the same operation, which can save time in the overall manufacturing of the part, or in the case where otherwise conventional sealing processes are simply prolonged, the advantage is that no additional process steps or equipment are required.

According to some embodiments, a post-anodizing heating process is applied to a metal alloy substrate that is sufficient to change the temper of the metal alloy substrate. These processes can include elements of a conventional heat treatment sequence for a high strength metal alloy performed after anodizing, but prior to sealing, allowing a wider range of temper conditions to be presented to the anodizing operation. This eliminates or mitigates a number of cosmetic defects, which are specific to the anodizing of high strength alloys in their final temper using conventional techniques.

Figure 9A:
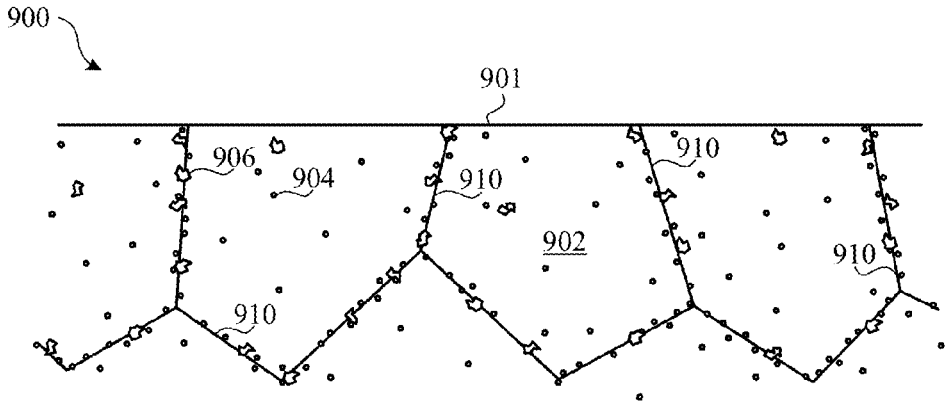
FIGS. 9A-9B show section views of a surface portion of a part that includes a high strength metal alloy substrate undergoing a conventional anodizing process.
Figure 9B:
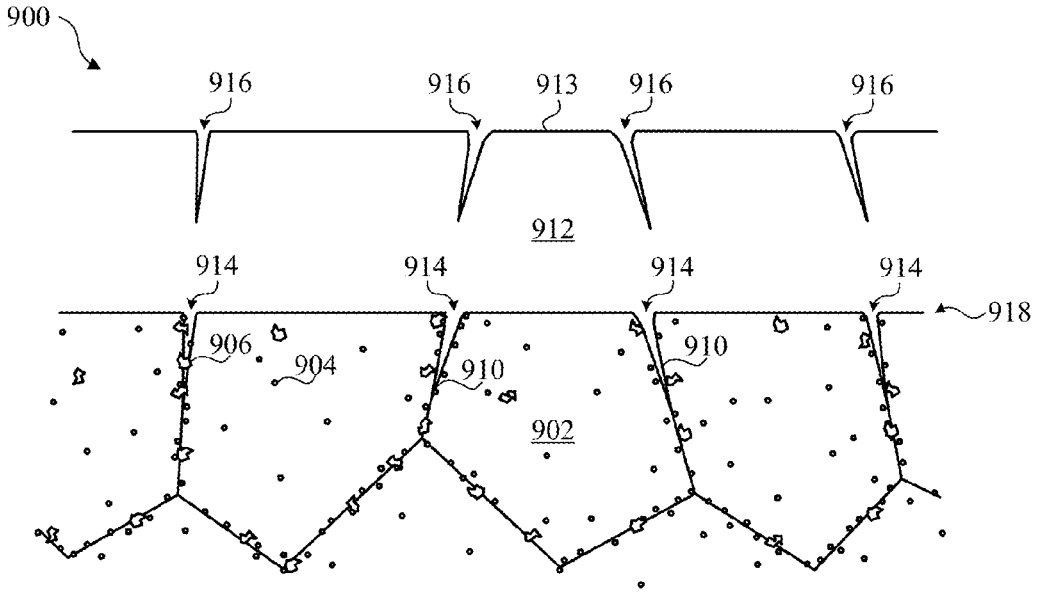

To illustrate, FIGS. 9A-9B show section views of a surface portion of part 900, which includes a high strength metal alloy substrate 902, undergoing a conventional anodizing process. FIG. 9A shows part 900 prior to an anodizing process, with surface 901 corresponding to an exposed surface of part 900. Part 900 includes metal alloy substrate 902, which has grain boundaries 910 at the interfaces between the grains of metal alloy substrate 902. Metal alloy substrate includes alloying elements 904. For example, typical 2000 series aluminum alloys include copper, typical 6000 series aluminum alloys include silicon and magnesium, and typical 7000 series aluminum alloys include zinc and magnesium. These alloying elements 904 are dispersed with in a metal matrix (e.g., aluminum). Other alloying elements in aluminum alloys can include chromium, manganese and iron. Metal alloy substrate 902 is age hardened, also referred to as precipitate hardened. In general, age hardening refers to a technique used to increase the strength of alloys by creating precipitate particles 906 within the metal matrix of metal alloy substrate 902. Precipitate particles 906 are fine particles of an impurity phase that impede the movement of dislocations (defects in the crystal lattice) of metal alloy substrate 902, thereby strengthening or hardening metal alloy substrate 902.

Typical age hardening involves two processes. First, metal alloy substrate 902 is heated to a temperature above its solvus temperature for a sufficient time for alloying elements 904 to become fully dissolved in a solid solution of the matrix, and homogeneously distributed. The metal alloy substrate is then quickly cooled (quenched) such that alloying elements 904 are in a super-saturated solid solution within the metal alloy substrate 902. This process is "solution heat treatment", sometimes also referred to as homogenizing. The purpose of rapid quenching to a low temperature is to avoid growth of any precipitates (facilitated by the kinetic energy provided by higher temperatures), whilst reaching the low temperatures at which there is the greatest driving force for nucleation of a second phase (the precipitates). This may be combined with a shaping or forming process that involves heating metal alloy substrate 902 at or near the solvus temperature and then quenching metal alloy substrate 902 immediately after the forming process (e.g., T1 aluminum alloy). Such processes, which can be referred to as "hot working" or "hot forming" processes, can include rolling, extrusion, or other suitable working process.

The second part of a typical age hardening process is the carefully controlled growth of these precipitates. This is achieved by re-heating the homogenized substrate 902 to a temperature (lower than that used for homogenizing), and holding the alloy at this temperature for several hours such that the supersaturated alloying elements 904 cause growth of precipitate particles 906. This second process can be referred to as an aging process, an age hardening process, a precipitate hardening process, an artificial aging process, or sometimes simply a heat treatment process. The second, artificial aging process may itself be conducted in more than one step, in order to optimize the distribution and size of precipitates particles 906. In some cases, it may be deliberately curtailed, to yield a partially hardened (e.g., "half hard") alloy temper, which still has further scope for further hardening through a further aging process. This partially hardened condition is exploited in one of the preferred embodiments described herein. Alloying elements 904 and precipitate particles 906 tend to aggregate or become enriched along grain boundaries 910. The degree to which metal alloy substrate 902 is age hardened can be reflected by its temper designation. For example, T6 generally refers to a peak-aged aluminum alloy substrate, which exhibits the maximum achievable strength and hardness.

FIG. 9B shows part 900 after an anodizing process, where surface 901 is exposed to an anodizing process. During anodizing, portions of metal alloy substrate 902 are converted to a corresponding anodic oxide film 912. As such, surface 913 of anodic oxide film 912 corresponds to an exposed surface of part 900. Non-alloy substrates, such as pure aluminum substrates or lightly alloyed aluminum substrates (e.g., some 1000 series alloys), can anodize to produce highly transparent, clear, colorless, and uniform anodic oxide films that have a defect-free substrate/oxide interface. However, alloying elements 904 within metal alloy substrate 902 can have deleterious effects on the cosmetics of part 900 after anodization, such as discoloring part 900. For example, chromium, copper and/or manganese can discolor an aluminum oxide film, copper can discolor an underlying aluminum alloy substrate, silicon can make an aluminum oxide film less transparent or clear, and zinc, magnesium and/or silicon can make an aluminum oxide film and its surface less uniform. Some of these cosmetic defects relate to the distribution of alloying elements 904 in metal alloy substrate 902 prior to anodizing, and are therefore observed to differing degrees depending on tempering conditions when tempering metal alloy substrate 902.

Many cosmetic defects are particularly apparent when metal alloy substrate 902 is an aged high strength alloy (e.g., T6 aluminum alloys). In particular, grooves 914 form within metal alloy substrate 902 where surface 901 of metal alloy substrate 902 intersect with grain boundaries 910. Grooves 914 are formed when alloying elements 904 and/or precipitate particles 906 aggregated along grain boundaries 910 and act as corrosion sites during the anodizing process and/or during a pre-anodizing process (e.g., chemical polishing), causing portions of metal alloy substrate 902 to corrode away. Since anodizing involves converting a portion of metal alloy substrate 902 to a conformal anodic oxide film 912, corresponding grooves 916 form along surface 913 of anodic oxide film 912. The number and size of grooves 914 and 916 can vary depending on factors such as the type and temper of metal alloy substrate 902. In some circumstances, grooves 914 may develop into ridges as anodizing proceeds, since the defective oxide corresponding to the oxidation of grain boundaries may inhibit coating growth. Grooves 916 in the outer surface of anodic oxide film 912 may then have corresponding ridges at the interface 918 of metal alloy substrate 902 and anodic oxide film 912, rather than the further set of grooves 914 illustrated. Either way, the disturbances in the interface 918 can interrupt an otherwise smooth, mirror-like interface, and imperfections in the visual appearance of the surface 913 after anodizing.

In some cases, grooves 914 and/or grooves 916 are not immediately obvious from a cosmetic point of view after anodizing. However, grooves 916 along surface 913 can make part 900 more susceptible to uptake of dirt and grease during use of part 900. For example, if part 900 corresponds to electronic device handled by a user, dirt and/or grease from the user's hands can become entrapped within grooves 916. After a period of use, the dirt and/or grease can accumulate within grooves 916 to a point where anodic oxide film 912 is no longer transparent and part 900 appears to have a clouded appearance.

Cosmetic defects in anodized aluminum finishes, such as the grooving described above, can be avoided by integrating parts of a conventional aging process sequence for an alloy into a sequence of an anodizing process. For example, part or all of the artificial aging of an aluminum alloy to accomplish a full T6 peak aged temper, which is conventionally only performed before anodizing, can be performed after an anodizing process. This allows alloys to be anodized in tempers such a W or T4 (solution heat treated, but without subsequent artificial aging) condition or in a partially aged "half-hard" condition, yielding better cosmetics, with an aging process being applied after anodizing to obtain a maximum strength after the optimal cosmetics of the anodic oxide film have been established.

Figure 10A:
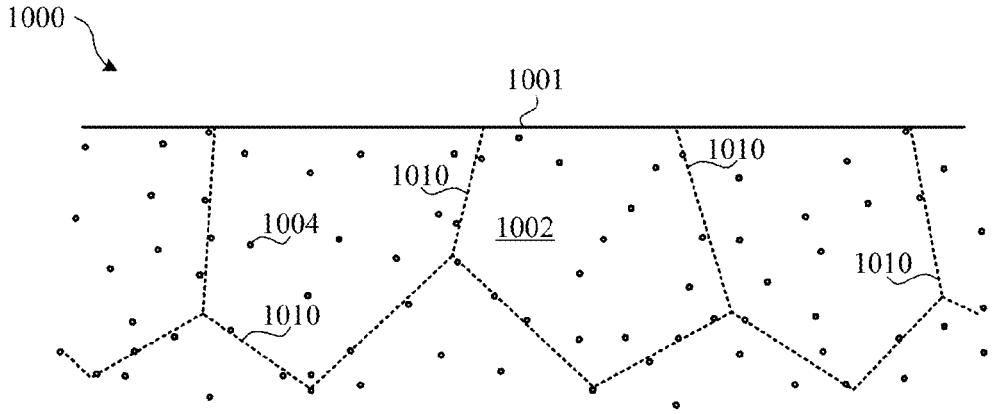
FIGS. 10A-10C show section views of surface portion of a part being formed using a post-anodizing aging process, in accordance with some embodiments.
Figure 10B:
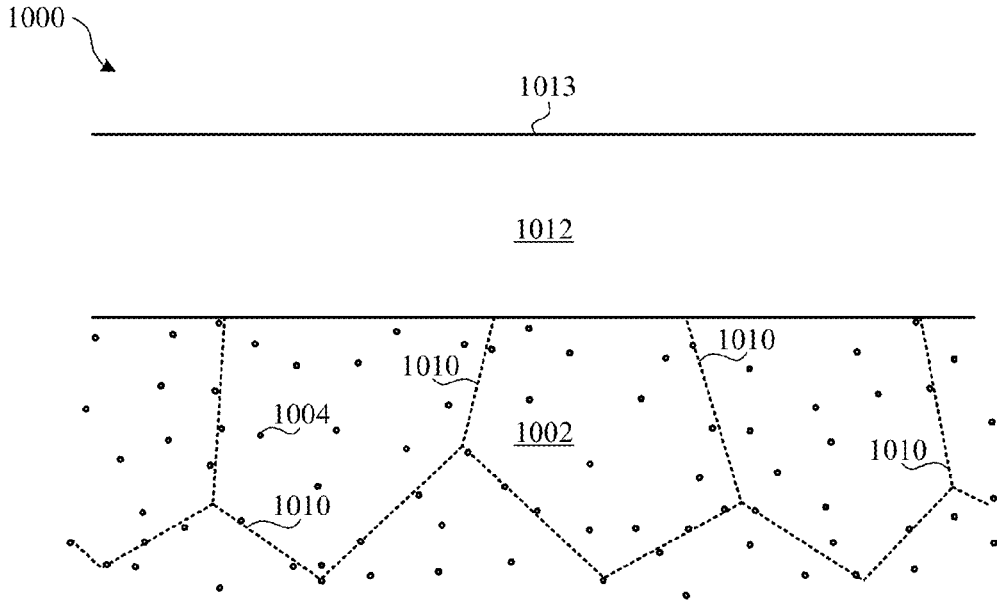
Figure 10C:
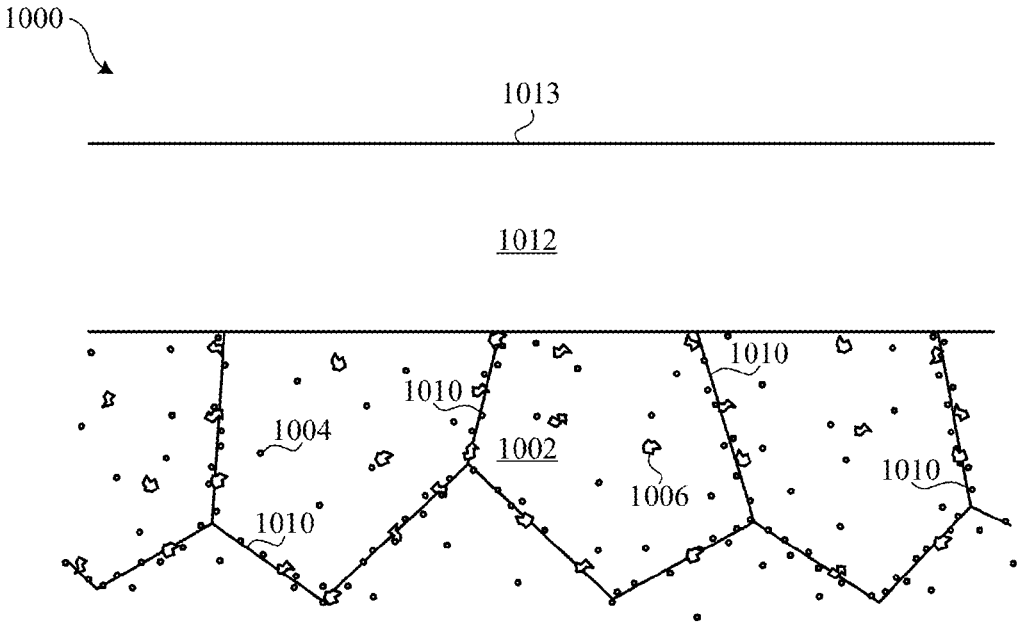

FIGS. 10A-10C show section views of a surface portion of part 1000 being formed using a post-anodizing aging process, in accordance with described embodiments. FIG. 10A shows part 1000 prior to an anodizing process, with surface 1001 corresponding to an exposed surface of part 1000. Part 1000 can correspond to any type of part, such as a housing or enclosure for consumer products 102, 104 or 106 described above with reference to FIG. 1. Part 1000 includes metal alloy substrate 1002, which has grain boundaries 1010 at the interfaces between the grains of metal alloy substrate 1002. Metal alloy substrate 1002 includes alloying elements 1004. The choice of metal alloy can depend on desired physical characteristics (e.g., hardness and strength) and/or cosmetic characteristics (e.g., color) of the metal alloy. In particular applications, 7000 and 2000 series aluminum alloys are used. As described above, some 7000 series aluminum alloys can have a bluish hue and some 2000 series aluminum alloys can have a yellowish hue. Thus, in some applications, it may be preferable to use a 7000 series aluminum alloy over a 2000 series aluminum alloy, or vice versa.

Metal alloy substrate 1002 is in an age-hardenable state. Age-hardenable can refer to a metal alloy that is capable of being hardened or strengthened using a subsequent aging or heat treatment process. In some embodiments, metal alloy substrate 1002 is in a homogenized state, partially homogenized state or a homogenized and partially aged state. As described above, homogenizing involves heating metal alloy substrate 1002 to a temperature sufficient to cause alloying elements 1004 to become homogeneously distributed within the metal matrix (e.g., aluminum) of metal alloy substrate 1002. Metal alloy substrate 1002 is then quickly cooled (quenched) such that alloying elements 1004 are in a supersaturated state within the metal matrix. In some embodiments, a water quenching or air quenching process is used. In some embodiments, the quenching occurs in a water-free or moisture-free environment. The homogenizing process uniformly distributes alloying elements 1004 such that alloying elements 1004 do no significantly aggregate or enrich along grain boundaries 1010. In addition, homogenizing can dissolve any pre-existing precipitate particles back into the metal matrix. As a result, grain boundaries 1010 are less pronounced in microstructural chemical terms, and less susceptible to different behavior from the matrix during chemical pre-treatment or anodizing.

In some embodiments, metal alloy substrate 1002 is partially homogenized such that some alloying elements 1004 are redistributed away from grain boundaries, while some alloying elements 1004 remain aggregated along grain boundaries 1010. In some cases, the partially homogenized metal alloy substrate 1002 includes some precipitate particles. The amount of homogenization of metal alloy substrate 1002 can vary depending on desired results and on process limitations, such manufacturing requirements and supply limitations. In some embodiments, the homogenization involves heating metal alloy substrate 1002 to a temperature (homogenizing temperature) then quenching the metal alloy substrate 1002 to prevent substantial growth of precipitate particles. In some embodiments, the metal alloy substrate 1002 is heated to a homogenizing temperature ranging between about 500 degrees C. and about 600 degrees C. for a time period ranging between about 1 and about 9 hours. In a particular embodiment, an aluminum alloy substrate is heated to between about 500 degrees C. and about 600 degrees C. for between about 1 to 2 hours. In some cases, an aluminum alloy substrate having a T4 temper is formed. In some embodiments, an aluminum alloy substrate has a W or O temper, with O corresponding to a substantially fully homogenized alloy.

In some embodiments, the metal alloy substrate is in an over-aged state (not shown). Over-aging generally involves age hardening an alloy to a point where the alloying elements form very large precipitate particles that are dispersed within the metal matrix. The precipitate particles are so large and disperse that they do not sufficiently interact with dislocations of the metal alloy substrate, and therefore do not significantly strengthen or harden the metal alloy substrate. In some cases the precipitate particles are substantially uniformly distributed within the metal matrix such that they do not preferentially aggregate along grain boundaries of the metal alloy substrate. Examples of suitable over-aged aluminum alloy substrates can include some 7000 and 2000 series aluminum alloys having a T78, T76 or T73 temper.

In some preferred embodiments, the metal alloy substrate is in a homogenized and partially hardened temper (e.g., "half-hard") where one part of a two-part aging treatment has been conducted before machining and anodizing. The metal alloy substrate can be placed at an optimal hardness for machining. The second part of the aging process may be performed after anodizing to leave the metal alloy substrate at its optimal, peak hardness.

Metal alloy substrates, when in a homogenized, partially homogenized, homogenized and partially aged or over-aged state, are generally softer and more malleable compared to when in an age hardened state. Thus, it can be easier to change a shape of the metal alloy substrate to a desired shape while in the homogenized, partially homogenized, homogenized and partially aged or over-aged state. For example, in a machining operation, the softer metal alloy substrates can put less wear on the tools, thereby extending the life of the tools. Alternatively, the tools can be made of materials that are less hard and less expensive than tools used to machine fully age hardened alloys. In a surface finishing operation, the softer metal alloy substrates can be finished with a less abrasive material and/or for less time. In a surface texturing operation (e.g., blasting), a less abrasive material can be used. These differences can provide important operational and cost benefits when manufacturing numerous parts of a product line. In particular, machining time can be reduced and the tool life can be extended. The degree of softness and malleability of the metal alloy substrate will depend on a number of factors such as the type of alloy (type of metal and alloying elements) and the degree of homogenization, partial aging, or over-aging. Although a softer metal alloy substrate provides these benefits, the metal alloy substrate should still be rigid enough to maintain a shape while being machined and/or finished. In general, the higher degree of homogenization or over-aging, the more malleable the substrate will be. Thus, one can obtain a predetermined amount of malleability and rigidity for the substrate by choosing a degree of homogenization, partial aging, or over-aging.

FIG. 10B shows part 1000 after an anodizing process that forms anodic oxide film 1012. Anodic oxide film 1012 is mainly made of a corresponding oxide material of metal alloy substrate 1002. For example, an aluminum metal alloy substrate 1002 will result in an anodic oxide film 1012 mainly made of aluminum oxide. Surface 1013 of anodic oxide film 1012 corresponds to an exposed surface of part 1000. As shown, metal alloy substrate 1002 and anodic oxide film 1012 are free of grooves associated with corrosion of alloying elements 1004 and/or precipitate particles along grain boundaries 1010. In embodiments where metal alloy substrate 1002 is partially homogenized, homogenized and partially aged, or over-aged, anodic oxide film 1012 and metal alloy substrate 1002 may have some grain boundary grooves. However, these grooves will be much more subtle and less severe compared to an anodic oxide film formed from a peak age-hardened alloy (e.g., T6 aluminum alloy), such as shown in FIG. 9B. For metal alloys substrates that are over-aged, the resulting anodic oxide film can also have less grain boundary grooves since the large precipitate particles are substantially uniformly distributed and not predominately or exclusively located along grain boundaries. The parameters of the anodizing process can be chosen to produce an anodic oxide film 1012 having desired physical characteristic (e.g., hardness) and/or desired cosmetic appearance. In some embodiments, the anodizing process is optimized to form a substantially transparent finish for part 1000.

In some cases, anodizing while metal alloy substrate 1002 is in an age-hardenable state can result in the anodic oxide film to have a different color compared to an anodic oxide film formed on the corresponding age hardened metal alloy substrate. The color differences can be attributed to the different concentrations and distributions of alloying elements 1004 in the matrix and/or precipitate particles. The color differences can vary depending on the types and amounts of alloying elements, as well as the degree of homogenization, aging or over-aging of the metal alloy substrate.

Once anodic oxide film 1012 is formed, it is generally desirable to strengthen metal alloy substrate 1002 so that part 1000 is not easily deformable during further processing and during use of part 1000. FIG. 10C shows part 1000 after an aging process. As described above, an "artificial" aging, or "age hardening" process generally involves heating the metal alloy substrate 1002 to a temperature at which there is sufficient thermal energy for alloying elements that have been quenched into a super-saturated solid solution to form precipitates, which grow in a controlled manner over a matter of hours to yield an optimal distribution of optimally sized precipitate particles 1006. An optimally sized and distributed set of precipitate particles 1006 impedes the movement of dislocations (defects in the crystal lattice) of metal alloy substrate 1002, thereby strengthening or hardening metal alloy substrate 1002. Thus, metal alloy substrate 1002 gains strength yet anodic oxide film 1012 remains substantially groove-free and cosmetically appealing.

The temperature (age hardening temperature) at which metal alloy substrate 1002 is heated can vary depending on a number of factors including the type of metal alloy material and a desired final strength of metal alloy substrate 1002. In some embodiments, the temperature and cooling method are chosen to produce precipitate particles 1006 of a predetermined size. In some cases, precipitate particles 1006 are large enough to be visible by the human eye while in other cases precipitate particles 1006 are microscopic or submicroscopic. Age hardening generally involves heating metal alloy substrate 1002 to a lower temperature compared to a temperature used to homogenize metal alloy substrate 1002 (at FIG. 10A). In a particular embodiment where an aluminum alloy is used, metal alloy substrate 1002 is heated to temperature ranging between about 150 degrees C. and 160 degrees C. for between about 8 and 10 hours, resulting in a T6 temper high strength aluminum alloy. After heating, metal alloy substrate 1002 is typically slowly cool to allow for controlled growth of the precipitate particles 1006. In some embodiments, metal alloy substrate 1002 is allowed to cool in ambient room temperature conditions. In some embodiments, it may be important to avoid hydration (exposure to water or moisture) during the heating and cooling process in order to avoid sealing of anodic oxide film 1012.

For metal alloy substrates that are over-aged prior to anodizing, after anodizing the over-aged metal alloy substrate can be homogenized and then re-aged. That is, the anodized over-aged metal alloy substrate can be exposed to a homogenizing process, whereby the large precipitate particles are dissolved back into the metal matrix and quenched, putting the metal alloy substrate into a homogenized or partially homogenized state. Then, an aging process is performed to re-form the precipitate particles, this time in a way that strengthens the metal alloy substrate. Since the anodic oxide film is substantially groove-free, the end result will be a hardened metal alloy substrate with a cosmetically appealing finish.

In one preferred embodiment, where the metal alloy substrate was partially aged prior to machining and anodizing, so as to be of optimal strength, hardness and ductility for forming and machining operations, the artificial aging may now be completed after anodizing to yield the maximum strength and hardness of the metal alloy substrate.

After the aging process is complete and metal alloy substrate 1002 is sufficiently strengthened, one or more post-anodizing operations can be performed. For example, anodic oxide film 1012 can be dyed using one or more dyeing processes, polished, and/or sealed. In some embodiments, part 1000 is then assembled with other portions of a final product.

EXAMPLES

Presented below are some specific examples of post-anodizing aging processes performed on aluminum alloy substrates.

Example 1

A T4 homogenized 7000 series aluminum alloy enclosure is machined prior to chemical polishing and anodizing. This minimizes or eliminates preferential etching of grain boundaries and eliminates the grooves in the anodic oxide film surface of the finished enclosure. The strength of the aluminum alloy is restored to a T6 condition by aging (heat treating) after anodizing.

Example 2

Anodizing is performed on a 2000 series aluminum alloy that is heavily over-aged condition (e.g., T73) to minimize the level of free copper in the aluminum matrix, and minimize the consequent enrichment of copper at the aluminum alloy/anodic oxide interface (which occurs as a result of preferential oxidation of aluminum) and minimize the corresponding discoloration of the anodic oxide film surface. This also minimizes the discrepancy between the growth rates of grains of different orientations, allowing more uniform anodic oxide films to be grown, and avoiding a pit-like appearance due to deeper growth of anodic oxide on grains of certain preferred orientations.

Figure 11:
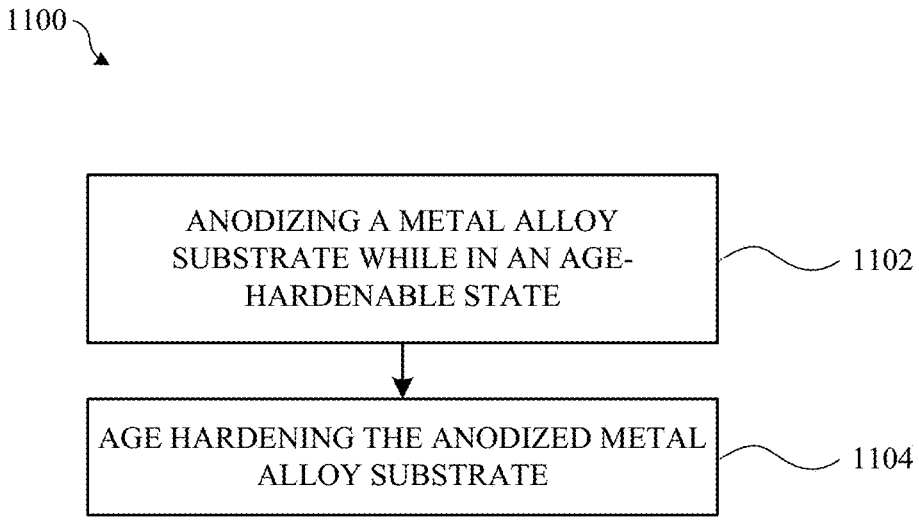
FIG. 11 shows a flowchart indicating a high level process for performing a post-anodizing aging process, in accordance with some embodiments.

FIG. 11 shows flowchart 1100 indicating a high level process for performing a post-anodizing aging process, in accordance with described embodiments. At 1102, a metal alloy substrate that is in an age-hardenable state is anodized. Generally, this means that prior to anodizing, the metal alloy substrate is homogenized, partially homogenized, homogenized and partially aged, as described above. The metal may also be over-aged, with subsequent re-homogenization and re-aging to be performed. A homogenized metal alloy substrate will have homogenous arrangement of alloying elements where the alloying elements are substantially uniformly distributed within a metal matrix of the metal alloy substrate. Therefore the alloying elements will not be preferentially aggregated along grain boundaries of the metal alloy substrate. A partially homogenized or homogenized and partially aged metal alloy substrate will have some amount of non-uniform distribution of alloying elements and/or precipitate particles. However, the alloying elements and/or precipitate particles should not be aggregated along the grain boundaries to a degree that causes substantial grain boundary grooving. The degree to which a partially homogenized metal alloy substrate, or homogenized metal alloy substrate that is partially aged, is homogenized will depend on a number of factors including the type of alloy. An over-aged metal alloy substrate can have large precipitate particles that are substantially uniformly distributed and not preferentially along grain boundaries. The resultant anodized age-hardenable metal alloy substrate will be substantially free of defects related to grain boundary grooving.

At 1104, the anodized metal alloy substrate is age-hardened to achieve its peak strength and hardness. The age hardening process increases a strength of the metal alloy substrate, making it more useable for many applications. In a particular embodiment, the metal alloy substrate corresponds to an enclosure, or a portion of an enclosure, for a consumer electronic product. In these embodiments the metal alloys substrate should be strong enough to withstand stresses incurred by normal use of the electronic device. The age hardening process generally involves heating the metal alloy substrate to a temperature at which controlled growth of precipitates may be achieved to an optimal size over a matter of hours.

Figure 12:
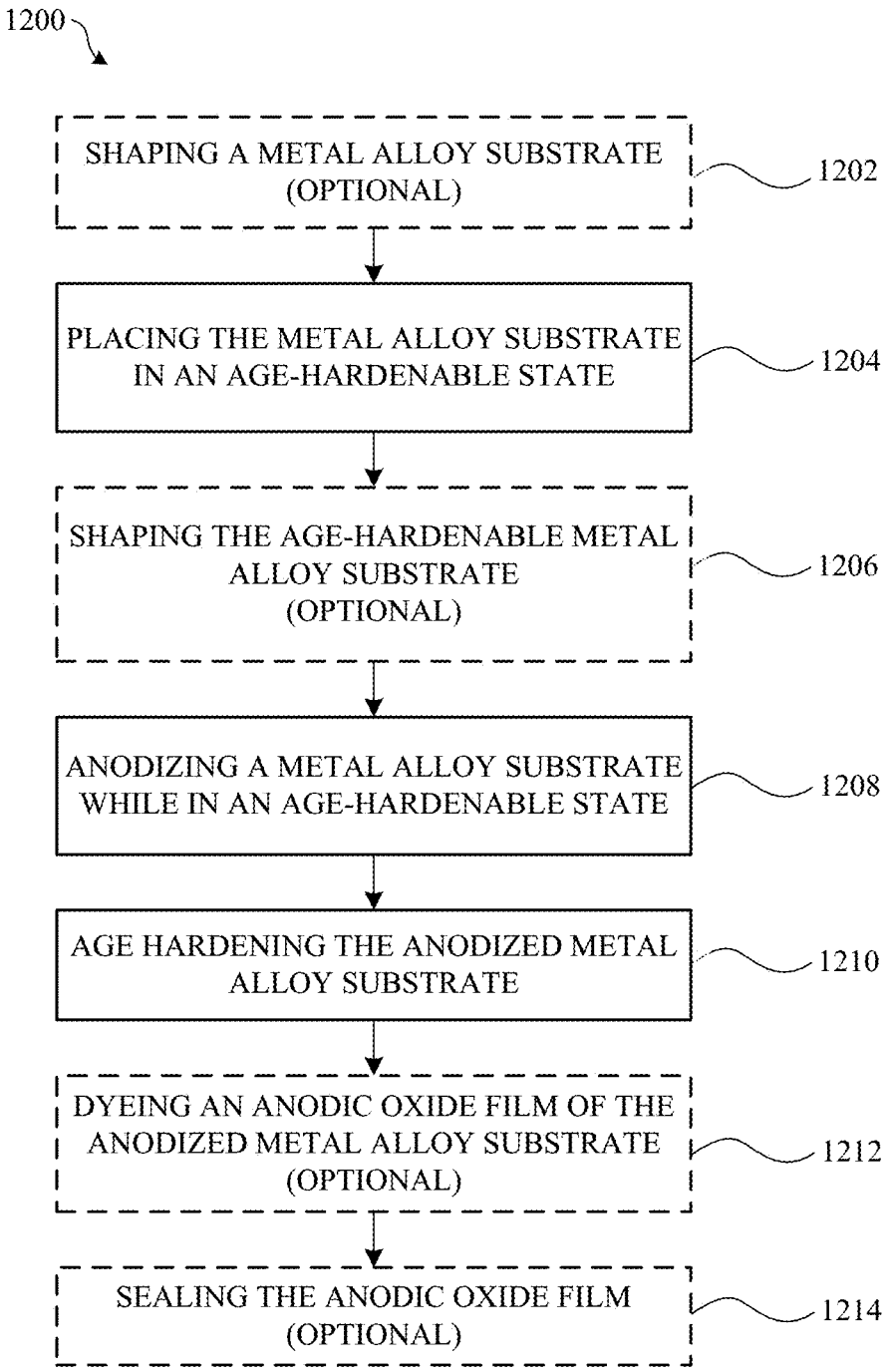
FIG. 12 shows a flowchart indicating manufacturing processes that include a post-anodizing aging process, in accordance with some embodiments.

FIG. 12 shows flowchart 1200 indicating a manufacturing process that includes a post-anodizing aging process, in accordance with some embodiments. At 1202, one or more optional shaping operations are performed on a metal alloy substrate. The shaping operations can include casting, extruding, machining (e.g., cutting or milling), lapping, polishing and/or texturing (e.g., blasting and/or chemical etching) operations. In some embodiments, the one or more shaping operations shape the metal alloy substrate to nearly a final shape of a part, such as a shape of an enclosure for an electronic device. The metal alloy substrate can be made of any suitable alloy. In particular embodiments, the metal alloy substrate is a 7000 series or 2000 series aluminum alloy. At this point the metal alloy substrate can be in any state of temper. For example, an aluminum alloy substrate can be in a homogenized or partially homogenized state (e.g., T4, W or O), hardened state (e.g., T6) or an over-aged state (e.g., T78, T76 or T73). The temper of the metal alloy substrate may depend on manufacturing requirements and availability, such as from a supplier of the metal alloy material. In one preferred embodiment, the aluminum alloy substrate is homogenized and partially age-hardened (e.g. to a "half-hard" state), so as to present an optimal combination of strength, hardness and ductility for the shaping operations. After anodizing, the remaining part of the artificial age-hardening sequence is completed to yield the peak strength and hardness of the metal alloy substrate for its service life.

At 1204, the metal alloy substrate is placed in an age-hardenable state. This means that the metal alloy substrate is processed such that it is capable of being strengthened using a subsequent aging process. As described above, this may include homogenizing, partially homogenizing or over-aging the metal alloy substrate using one or more heating methods. In some situations the metal alloy substrate can be purchased from a supplier in a predetermined age-hardenable state. For example, an aluminum alloy substrate can be purchased in a homogenized or partially homogenized state (e.g., T4, W or O) or an over-aged state (e.g., T78, T76 or T73).

At 1206, the age-hardenable metal alloy substrate is optionally shaped to a predetermined shape. This shaping operation can be done in addition to or instead of the shaping in 1202. The shaping can include one or more casting, extruding, machining (e.g., cutting or milling), lapping, polishing and/or texturing (e.g., blasting and/or chemical etching) operations. The age-hardenable metal alloy substrate is generally softer than when it is in a hardened state. This may significantly improve machining efficiency or performance, or may be used to increase tool life.

Note that the optional shaping operations 1202 and 1206 allow for shaping the metal alloy substrate in a wider range of states (e.g., tempers) compared to conventional manufacturing processes that involve shaping the substrate while in a final hardened state. In some cases, it may be preferable to perform all shaping operations prior to placing the metal alloy substrate in an age-hardenable state (1202). In other cases, it may be preferable to perform all shaping operations while the metal alloy substrate is in an age-hardenable state (1206). In other cases, it may be preferable to perform some shaping operations prior to placing the metal alloy substrate in an age-hardenable state (1202) and other shaping operations after placing the metal alloy substrate in an age-hardenable state (1206). For example, it may be desirable to perform certain machining operations prior to placing the metal alloy substrate in an age-hardenable state (1202) and then perform a re-homogenization to place the part to an age-hardenable state (1206) prior to finishing operations (e.g., etching, chemical polishing and anodizing). These options provide more flexibility when designing a manufacturing process.

At 1208, the metal alloy substrate is anodized while in an age-hardenable state, forming an anodic oxide film. In some cases, one or more pre-anodizing processes, such as chemical polishing or etching, are performed immediately prior to anodizing to enhance the cosmetics of the metal alloy substrate. Since the metal alloy is in an age-hardenable state, alloying elements and/or precipitate particles are substantially homogenously distributed within the metal matrix and not significantly preferentially along grain boundaries. Thus, the pre-anodizing and anodizing do not cause sufficient corrosion along grain boundaries that can form grooves within the metal alloy substrate and the anodic oxide film. That is, the anodic oxide film is substantially free of defects related to grain boundary grooving. In some applications the anodic oxide film is substantially clear or transparent, allowing a clear view of the underlying metal alloy substrate.

At 1210, the anodized metal alloy substrate is age hardened in order to place the metal alloy substrate into a strengthened and more usable form. This generally involves causing the alloying elements to form precipitate particles such that the precipitate particles impede the movement of dislocations of the metal alloy substrate. Since the anodic oxide film has already been formed, the formation of precipitate particles does not cause the above-described grain boundary grooving with the metal alloy substrate. In particular embodiments using an aluminum alloy, this involves heating the aluminum alloy to a temperature ranging between about 150 degrees C. and 160 degrees C. for between about 8 and 10 hours, then allowing the aluminum alloy to slowly cool to room temperature.

At 1212, the anodic oxide film of the anodized metal alloy substrate is optionally dyed using one or more dyeing operations. In some embodiments, the dyeing operation(s) involve infusing organic or inorganic dyes within pores of the anodic oxide film. At 1214, the anodic oxide film is optionally sealed using one or more sealing operations. The sealing closes the pores of the anodic oxide film, making it less susceptible to taking up dirt and other foreign matter via fingerprints, etc.

Note that variations of the methods described above with reference to FIGS. 9-12 can be used. For example, the preceding description makes a number of references to processing aluminum alloys. It should be noted that the methods described herein may also be applicable to any other suitable anodizable metal alloys that are heat treatable, including certain zirconium, titanium and magnesium alloys. In some embodiments, the manufacturing process includes an optional dyeing step after age hardening. Variations such as dyeing before age hardening may be possible, and are considered to fall within the scope of described embodiments. Additionally, whilst the above description focuses on the cosmetics of a finished article, the process may be used to improve other aspects of the anodic oxide film and metal alloy substrate. For example, anodizing in an over-aged condition can minimize the enrichment of zinc at the metal oxide interface of certain zinc containing aluminum alloys, which can improve interfacial adhesion. The peak strength and hardness (e.g., T6) of an over-aged metal alloy substrate can be recovered after anodizing by re-solution-heat treating (homogenizing) and age hardening the alloy.

In some embodiments, aspects of the post-anodizing diffusion promoting processes described above with reference to FIGS. 1-8 are combined with the post-anodizing aging processes described above with reference to FIGS. 9-12. For example, after anodizing, a metal alloy substrate can be heated to a temperature and time period sufficient to cause diffusion of alloying elements away from the interface (between the anodic oxide film and the underlying substrate) and also to cause age hardening of the metal alloy substrate to its peak strength or hardness. For a given temperature, the time period for causing sufficient diffusion away from the interface is generally less than the time period for age hardening the metal alloy substrate. Thus, in some cases, a diffusion promoting process can be extended to age harden the metal alloy substrate. However, in some cases the intentional formation of precipitate particles during the aging process can detrimentally affect the color of the anodic oxide film finish. These factors should be weighed and taking into consideration when designing processes for particular applications and for producing desired results.

In one preferred embodiment, the temper of the metal alloy substrate prior to anodizing is adjusted (by slightly curtailing an optimal aging process), so that a post-anodizing heat treatment, tailored for diffusing interfacially enriched alloying elements away from the interface, is also optimal for completing the artificial aging process of the metal alloy substrate and achieving its peak strength and hardness.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A method of treating a part comprising a metal alloy substrate, the method comprising:

forming an anodic oxide film on the metal alloy substrate by anodizing the metal alloy substrate, wherein alloying elements from the metal alloy substrate are enriched at an interface between the metal alloy substrate and the anodic oxide film, wherein the alloying elements enriched at the interface are associated with an amount of discoloration of the anodic oxide film;

exposing the part to a diffusion promoting process causing at least some of the alloying elements enriched at the interface to diffuse away from the interface toward one or both of the metal alloy substrate and the anodic oxide film; and measuring a color of the anodic oxide film to determine whether the amount of discoloration is reduced to at least a predetermined amount of discoloration.

2. The method of claim 1, wherein the alloying elements enriched at the interface are associated with reducing an adhesion strength between the anodic oxide film and the metal alloy substrate, wherein the adhesion strength is increased after exposing the part to the diffusion promoting process.

3. The method of claim 1, wherein the alloying elements enriched at the interface are associated with galvanic corrosion of the metal alloy substrate, wherein exposing the part to the diffusion promoting process substantially prevents the galvanic corrosion of the metal alloy substrate.

4. The method of claim 1, wherein exposing the part to a diffusion promoting process comprises:

heating the part to a predetermined temperature.

5. The method of claim 4, wherein the predetermined temperature is about 150 degrees C. or higher.

6. The method of claim 4, wherein the predetermined temperature is between about 200 degrees C. and about 300 degrees C.

7. The method of claim 4, where the predetermined temperature is sufficiently low to substantially prevent cracking of the anodic oxide film.

8. The method of claim 1, wherein a surface of the part corresponds to an exposed surface of the anodic oxide film, wherein exposing the part to a diffusion promoting process comprises:

exposing the surface of the part to light.

9. The method of claim 8, wherein the part is positioned on a support that cools a portion of the metal alloy substrate during the exposure of the surface to light.

10. The method of claim 1, wherein exposing the part to a diffusion promoting process comprises:

exposing the part to a heated liquid, gas or a combination thereof.

11. The method of claim 10, wherein the heated liquid, gas or a combination thereof is substantially free of water.

12. The method of claim 10, wherein the heated liquid, gas or a combination thereof comprises water such that pores of the anodic oxide film become sealed while the alloying elements diffuse away from the interface.

13. The method of claim 10, wherein the heated liquid, gas or a combination thereof is heated to a temperature of about 150 degrees C. or higher.

14. A method of treating a part comprising a metal alloy substrate, the method comprising:

converting a portion of the metal alloy substrate to an anodic oxide film, wherein alloying elements from the metal alloy substrate become enriched within an enrichment layer at an interface between the metal alloy substrate and the anodic oxide film, wherein the alloying elements enriched within enrichment layer are associated with an amount of discoloration of the part;

removing at least a portion of the alloying elements from the enrichment layer so as to reduce the amount of discoloration; and measuring a color of the part to determine whether the amount of discoloration is reduced to at least a predetermined amount of discoloration.

15. The method of claim 14, wherein removing at least the portion of the alloying elements from the enrichment layer comprises removing substantially all the discoloration.

16. The method of claim 14, wherein measuring the color of the part includes measuring the part for amounts of yellow, blue, green or magenta color yellow, blue, green or magenta color.

17. The method of claim 14, wherein measuring the color of the part includes measuring an L* (brightness) value of the part.

18. The method of claim 14, wherein the alloying elements enriched within the enrichment layer is associated with a reduced adhesion strength of the anodic oxide film to the metal alloy substrate, wherein removing at least the portion of the alloying elements from the enrichment layer comprises increasing the adhesion strength.

19. The method of claim 14, wherein removing at least the portion of the alloying elements from the enrichment layer comprises:

heating at least a portion of the part to a predetermined temperature.

20. The method of claim 14, wherein the alloying elements include at least one of zinc, copper, manganese, iron and lead.

* * * * *